US009315034B2

(12) United States Patent
Ono et al.

(10) Patent No.: US 9,315,034 B2
(45) **Date of Patent: *Apr. 19, 2016**

(54) LIQUID CARTRIDGE HAVING VALVE CHAMBER IN WHICH MOVABLE BODY IS DISPOSED

(71) Applicant: Brother Kogyo Kabushiki Kaisha, Nagoya-shi, Aichi-ken (JP)

(72) Inventors: Akihito Ono, Nagoya (JP); Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/616,045

(22) Filed: Feb. 6, 2015

(65) Prior Publication Data

US 2015/0224780 A1 Aug. 13, 2015

(30) Foreign Application Priority Data

Feb. 10, 2014 (JP) ..... 2014-023764

(51) Int. Cl.
*B41J 2/175* (2006.01)

(52) U.S. Cl.
CPC ..... *B41J 2/17503* (2013.01); *B41J 2/1752* (2013.01); *B41J 2/17513* (2013.01); *B41J 2/17523* (2013.01); *B41J 2/17553* (2013.01); *B41J 2/17596* (2013.01)

(58) Field of Classification Search
CPC ..... B41J 2/175; B41J 2/17596; B41J 2/17503–2/17556
See application file for complete search history.

(56) References Cited

U.S. PATENT DOCUMENTS

| | | | | |
|---|---|---|---|---|
| 5,425,478 | A * | 6/1995 | Kotaki | B41J 2/17523 222/501 |
| 5,606,988 | A | 3/1997 | Pawlowski, Jr. | |
| 8,419,173 | B2 * | 4/2013 | Hayashi | B41J 2/175 347/31 |
| 2003/0071874 | A1 | 4/2003 | Ishizawa et al. | |
| 2005/0088497 | A1 * | 4/2005 | Katayama | B41J 2/17509 347/86 |
| 2015/0224779 | A1 * | 8/2015 | Okazaki | B41J 2/1752 347/86 |

FOREIGN PATENT DOCUMENTS

| | | | |
|---|---|---|---|
| JP | 2941189 | B2 | 8/1999 |
| JP | 2002-079683 | A | 3/2002 |
| JP | 4506301 | B2 | 7/2010 |

OTHER PUBLICATIONS

Feb. 6, 2015—Co-Pending U.S. Appl. No. 14/616,075.

* cited by examiner

*Primary Examiner* — Geoffrey Mruk
(74) *Attorney, Agent, or Firm* — Banner & Witcoff, Ltd.

(57) ABSTRACT

A liquid cartridge includes a liquid chamber, a valve chamber extending in a first direction away from the liquid chamber, first and second air channels, a movable body, and first and second sealing parts. The valve chamber is defined by a side wall surface and a proximal wall surface, the side wall surface extending in the first direction and having an annular-shaped cross-section and being formed with a first opening and a second opening separated from each other in a circumferential direction. The movable body is disposed within the valve chamber and movable in a in a second direction opposite to the first direction from a first state to a second state. In the first state, the first sealing part interrupts communication between the first and second openings. In the second state, the first opening and the second opening are in communication with each other.

14 Claims, 14 Drawing Sheets

LIQUID CARTRIDGE HAVING VALVE CHAMBER IN WHICH MOVABLE BODY IS DISPOSED

CROSS REFERENCE TO RELATED APPLICATION

This application claims priority from Japanese Patent Application No. 2014-023764 filed Feb. 10, 2014. The entire content of the priority application is incorporated herein by reference.

TECHNICAL FIELD

The present invention relates to a liquid cartridge that supplies liquid stored therein.

BACKGROUND

An inkjet recording device well known in the art records images on paper by ejecting ink stored in an ink cartridge onto the paper through nozzles formed in a recording head. When ink in the ink cartridge is consumed through image-recording processes performed by the inkjet recording device, the empty ink cartridge is removed and replaced with a new ink cartridge filled with ink.

The conventional ink cartridge has an ink supply unit for supplying ink, and an air communication unit that provides communication between a layer of air in an ink chamber that stores ink and the exterior of the device. The air communication unit is closed when the ink cartridge is stored so that the ink chamber is kept enclosed. When the ink cartridge is mounted in the inkjet recording device, the air communication unit is opened so that the ink chamber can be in communication with the external air.

One example of an ink cartridge mounted in an inkjet recording device includes a single valve mechanism for opening and closing both an ink channel and an air channel (see Japanese Patent Publication No. 4506301, for example). With this ink cartridge, an ink delivery tube inserted into a through-hole formed in a tubular member moves the tubular member through a frictional force generated between the two to open the air channel. Subsequently, the ink delivery tube moves a valve element against an urging force of a coil spring to open the ink channel.

SUMMARY

However, the conventional ink cartridge described above requires a relatively large amount of space to accommodate the tubular member and the valve element, resulting in a larger ink cartridge.

In view of the foregoing, it is an object of the present invention to provide a liquid cartridge provided with a structure for reducing a space for accommodating moving bodies required for establishing communication between the interior of the liquid cartridge and the external air.

In order to attain the above and other objects, there is provided a liquid cartridge that may include: a liquid chamber configured to store liquid therein; a valve chamber extending in a first direction away from the liquid chamber; a first air channel: a second air channel; a movable body; a first sealing part; and a second sealing part. The valve chamber is defined by a side wall surface and a proximal wall surface, the side wall surface extending in the first direction and having an annular-shaped cross-section taken along a plane orthogonal to the first direction, the side wall surface having a first end and a second end positioned downstream of the first end in the first direction, the proximal wall surface provided on the first end of the side wall surface, the side wall surface defining a circumferential direction and being formed with a first opening and a second opening, the first opening and the second opening being separated from each other in the circumferential direction and at least partially overlapping the plane. The first air channel is configured to allow air to flow between the valve chamber and ambient air through the first opening. The second air channel is configured to allow air to flow between the liquid chamber and the valve chamber through the second opening. The movable body is disposed within the valve chamber and configured to move in a in a second direction opposite to the first direction from a first state to a second state, the movable body having an outer surface. The first sealing part has an annular shape and is provided on the outer surface of the movable body, the first sealing part being in close contact with the side wall surface and configured to move in the second direction. The second sealing part has an annular shape and is provided on the outer surface of the movable body at a position toward the second end of the side wall surface from the first sealing part, the second sealing part being in close contact with the side wall surface and configured to move in the second direction, the first sealing part and the second sealing part defining an enclosed space therebetween in the valve chamber. When the movable body is in the first state, the first sealing part is positioned between the first opening and the second opening and interrupts communication therebetween, the second sealing part being positioned toward the second end of the side wall surface from the first opening and the second opening. When the movable body is in the second state, the first opening and the second opening are in communication with each other for allowing air to flow therebetween through the enclosed space.

DETAILED DESCRIPTION

1. First Embodiment

An ink cartridge 30 according to a first embodiment of the present invention and a printer 10 configured to accommodate the ink cartridge 30 will be described with reference to FIGS. 1 through 7B.

<Overall Structure of Printer 10>

Figure 1:
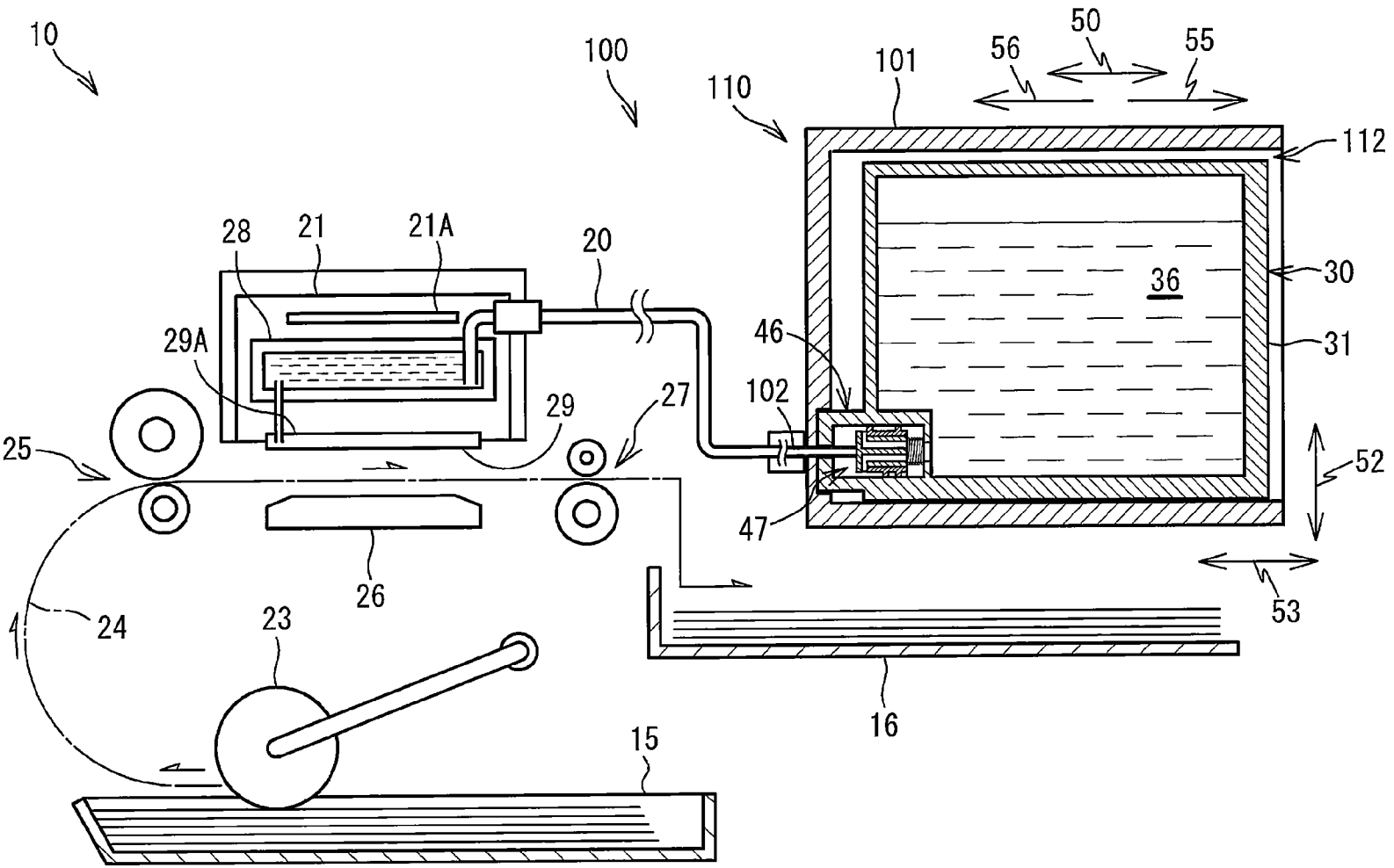
FIG. 1 is a schematic diagram illustrating an internal structure of a printer provided with a cartridge-mounting unit according to a first embodiment of the present invention.

The printer 10 employs an inkjet recording system for recording images on recording paper by selectively ejecting ink droplets toward the paper. As shown in FIG. 1, the printer 10 includes a recording head 21, an ink-supplying device 100, and an ink tube 20 connecting the recording head 21 to the ink-supplying device 100.

The ink-supplying device 100 is provided with a cartridge-mounting unit 110. The ink cartridge 30 (an example of a liquid cartridge of the invention) can be mounted in the cartridge-mounting unit 110.

An opening 112 is formed in one side of the cartridge-mounting unit 110. The ink cartridge 30 can be inserted into the cartridge-mounting unit 110 through the opening 112 in a mounting direction 56 (an example of a first direction of the invention) or can be extracted from the cartridge-mounting unit 110 through the opening 112 in a removing direction 55 (an example of a second direction of the invention).

The ink cartridge 30 is configured to store ink (an example of liquid of the invention) that the printer 10 can use in image formation. The ink tube 20 connects the ink cartridge 30 to the recording head 21 when the ink cartridge 30 is completely mounted in the cartridge-mounting unit 110.

The recording head 21 is provided with a sub-tank 28, and nozzles 29. The sub-tank 28 temporarily holds ink that is supplied through the ink tube 20. The recording head 21 selectively ejects ink supplied from the sub-tank 28 from the nozzles 29 according to an inkjet recording method. More specifically, the recording head 21 is provided with a head control board 21A, and piezoelectric elements 29A corresponding to each of the nozzles 29. The head control board 21A selectively applies drive voltages to the piezoelectric elements 29A to selectively eject ink from the nozzles 29.

The printer 10 has a paper-conveying mechanism that includes a paper tray 15, a feeding roller 23, a conveying path 24, a pair of conveying rollers 25, a platen 26, a pair of discharge rollers 27, and a discharge tray 16. The feeding roller 23 feeds recording paper from the paper tray 15 onto the conveying path 24, and the conveying rollers 25 convey the recording paper over the platen 26. The recording head 21 selectively ejects ink onto the recording paper as the paper passes over the platen 26, whereby an image is recorded on the paper. The discharge rollers 27 receive the recording paper that has passed over the platen 26 and discharge the paper onto the discharge tray 16 provided on the downstream end of the conveying path 24.

<Ink-Supplying Device 100>

As shown in FIG. 1, the ink-supplying device 100 is provided in the printer 10. The ink-supplying device 100 functions to supply ink to the recording head 21 provided in the printer 10. The ink-supplying device 100 includes the cartridge-mounting unit 110 in which the ink cartridge 30 can be mounted. The cartridge-mounting unit 110 includes a case 101, and an ink needle 102 (an example of a liquid extraction tube of the invention). FIG. 1 shows the state of the ink cartridge 30 when the ink cartridge 30 is completely mounted in the cartridge-mounting unit 110. Note that, while the cartridge-mounting unit 110 is provided with four ink needles 102 and can accommodate four ink cartridges 30 corresponding to the four colors cyan, magenta, yellow, and black, the following description will be concerned with the mutual operations of one ink needle 102 and the corresponding ink cartridge 30.

<Ink Needle 102>

The opening 112 is formed in the case 101. The case 101 has an inner back surface positioned on the opposite side of the case 101 from the opening 112. As shown in FIG. 1, the ink needle 102 protrudes in the removing direction 55 from the inner back surface of the case 101. The ink needle 102 is disposed on the inner back surface of the case 101 at a position for confronting a cylindrical wall 46 (described later) provided in the ink cartridge 30.

Figure 6A:
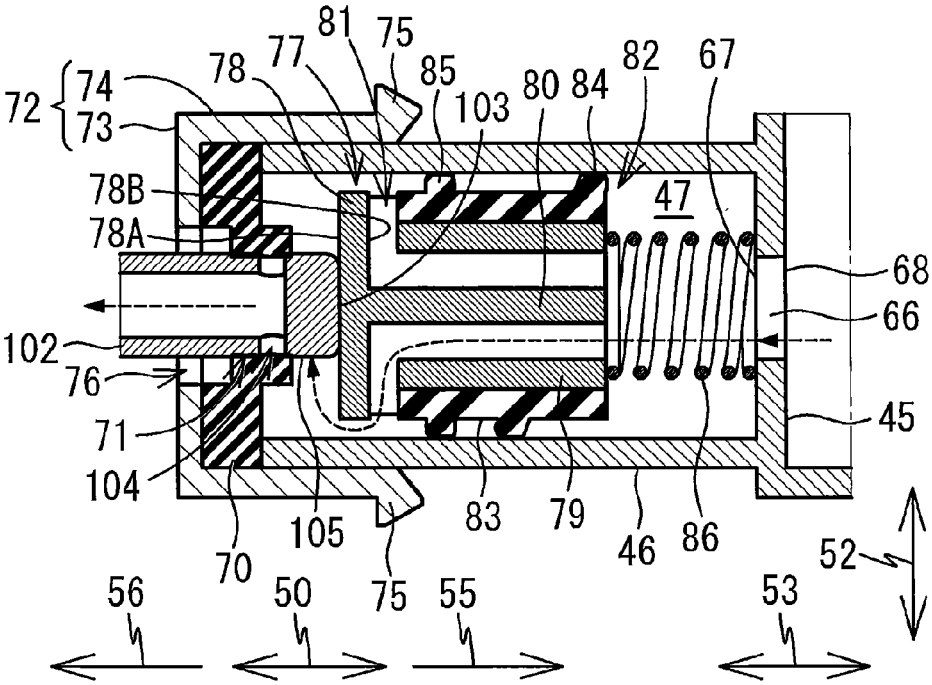
FIG. 6A is an enlarged cross-sectional view of the valve chamber in a vertical cross section of the ink cartridge according to the first embodiment viewed from its right side when the valve element and seal member are in a second state.
Figure 6B:
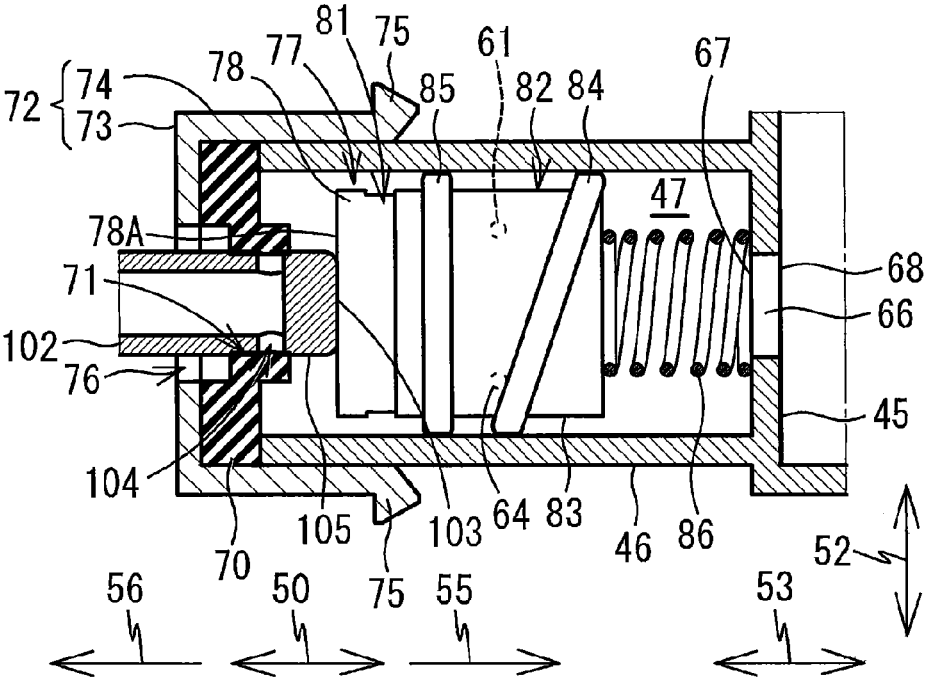
FIG. 6B is an enlarged cross-sectional view of the valve chamber in the vertical cross section of the ink cartridge according to the first embodiment viewed from its right side when the valve element and seal member are in the second state, wherein the valve element and seal member are shown as a side view and the openings of the valve chamber are indicated by broken lines.

As shown in FIGS. 6A and 6B, the ink needle 102 is a tube-like needle formed of resin. The ink needle 102 has a liquid channel in the center of the tube that runs along the longitudinal dimension of the ink needle 102. The ink needle 102 has a distal end 103 corresponding to the end that protrudes farthest from the inner back surface of the cartridge-mounting unit 110, and a pair of communication holes 104 formed in a circumferential wall of the ink needle 102 near the distal end 103. Although not shown in FIGS. 6A and 6B, the ink tube 20 is connected to a base end (opposite to the distal end 103) of the ink needle 102. The communication holes 104 are formed at positions slightly separated from the distal end 103 in a direction toward the base end of the ink needle 102, with one each on opposing sides of the central axis of the ink needle 102. The communication holes 104 provide fluid communication between the interior and exterior of the ink needle 102 so that ink can flow therethrough.

A third sealing part 105 constitutes the circumferential surface of the ink needle 102 between the distal end 103 and communication holes 104 and functions to slide over a seal member 70 described later. Communication holes that provide communication between the interior and exterior of the ink needle 102 are not formed in the distal end 103 and third sealing part 105. The dimension of the third sealing part 105 in the mounting and removing directions 50 is larger than the distance in the mounting and removing directions 50 between a first sealing part 84 (described later) and an opening 64 (described later) when a valve element 77 and a seal member 82 (described later) are in a first state, but is smaller than the distance in the mounting and removing directions 50 between a second sealing part 85 (described later) and an opening 61 (described later) when the valve element 77 and seal member 82 are in the first state.

When the ink needle 102 is inserted into the cylindrical wall 46 (described later) far enough for the communication holes 104 to be positioned inside the cylindrical wall 46, ink in an ink chamber 36 described later (an example of a liquid chamber) flows through a valve chamber 47 (described later) formed inside the cylindrical wall 46 into the ink tube 20 connected to the ink needle 102. Note that the definition of "needle" in this specification is a generic term that should include the meaning of a narrow tube-like member and need not be a member with a pointed tip.

<Ink Cartridge 30>

As shown in FIG. 2, the ink cartridge 30 includes a frame 31, and the cylindrical wall 46. The ink chamber 36 is formed inside the frame 31, and the valve chamber 47 (also see FIGS. 5A and 5B) is formed inside the cylindrical wall 46. The ink cartridge 30 supplies ink stored in the ink chamber 36 externally through the valve chamber 47. The ink cartridge 30 is inserted in and extracted from the cartridge-mounting unit 110 along the mounting and removing directions 50 while in an erected state shown in FIG. 2, i.e., with the bottom surface of the ink cartridge 30 in FIG. 2 positioned on the bottom and the top surface of the ink cartridge 30 in FIG. 2 positioned on the top. The mounting and removing directions 50 are horizontal directions in the present embodiment. Further, a left-right direction 51 and a front-rear direction 53 with respect to the ink cartridge 30 are also horizontal when the ink cartridge 30 is in its erected state. Up-down direction 52 with respect to the ink cartridge 30 in its erected state is aligned with the direction of gravity (vertical). The removing direction 55 and mounting direction 56 correspond to the mounting and removing directions 50 and are opposing directions to each other. The mounting and removing directions 50 are also aligned with the front-rear direction 53.

<Frame 31>

The frame 31 has an external shape similar to a rectangular parallelepiped that appears flattened in the left-right direction 51 so that the dimension of the frame 31 in the left-right direction 51 is small and the dimensions of the frame 31 in the up-down direction 52 and front-rear direction 53 are greater than the dimension in the left-right direction 51. The frame 31 is configured of a front wall 40 and a rear wall 41 that at least partially overlap each other when projected in the front-rear direction 53, a top wall 39 and a bottom wall 42 that at least partially overlap each other when projected in the up-down direction 52, and a left wall 38 disposed on one side of the frame 31 with respect to the left-right direction 51 (on the left side of the frame 31 when viewing the frame 31 from the front wall 40 side in the example of FIG. 2). The front wall 40 is the side of the frame 31 facing forward when the ink cartridge 30 is mounted in the cartridge-mounting unit 110, while the rear wall 41 faces rearward. The frame 31 is formed of a resin material, for example.

The top wall 39 is connected to top edges of the left wall 38, front wall 40 and rear wall 41. The bottom wall 42 is connected to bottom edges of the left wall 38, front wall 40, and rear wall 41. The left wall 38 is connected to left edges of the top wall 39, front wall 40, rear wall 41, and bottom wall 42. The side of the frame 31 opposite the left wall 38 in the left-right direction 51 (the right side of the frame 31 when viewing the frame 31 from the front wall 40 side in the example of FIG. 2) is open. This open side of the frame 31 is sealed by a film 43. The film 43 has an outer shape substantially equal to the outer shape of the frame 31 when viewed in the left-right direction 51. The film 43 is disposed on the side of the frame 31 opposite the left wall 38 in the left-right direction 51 (the right side) and constitutes a right wall 37 of the ink chamber 36 with respect to the left-right direction 51. The film 43 is heat-sealed to the right end faces of the top wall 39, front wall 40, rear wall 41, and bottom wall 42. The resulting ink chamber 36 defined by the left wall 38, top wall 39, front wall 40, rear wall 41, bottom wall 42, and film 43 can store ink.

<Valve Chamber 47>

Figure 5A:
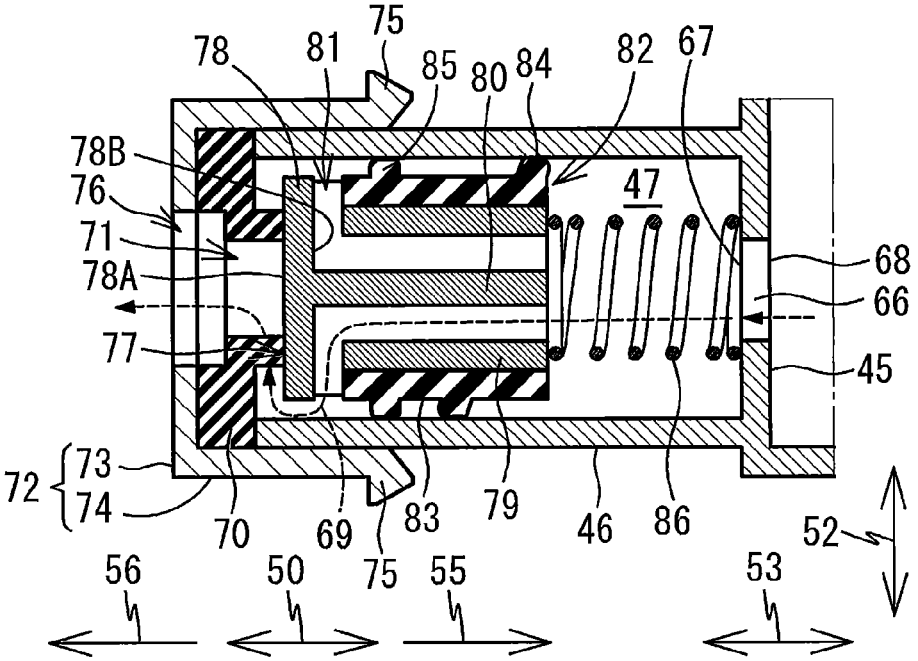
FIG. 5A is an enlarged cross-sectional view of the valve chamber in a vertical cross section of the ink cartridge according to the first embodiment viewed from its right side when the valve element and seal member are in a first state.
Figure 5B:
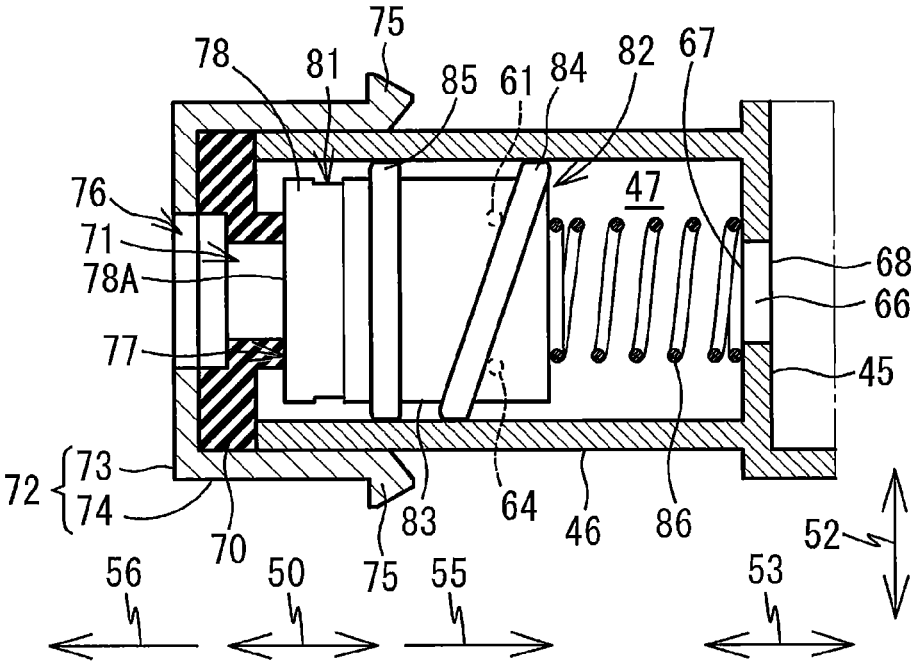
FIG. 5B is an enlarged cross-sectional view of the valve chamber in the vertical cross section of the ink cartridge according to the first embodiment viewed from its right side when the valve element and seal member are in the first state, wherein the valve element and seal member are shown as a side view and openings formed in the valve chamber are indicated by broken lines.

As shown in FIGS. 5A and 5B, the ink cartridge 30 also includes a proximal wall 45 disposed on the end of the cylindrical wall 46 positioned inside the frame 31. The valve chamber 47 is a space defined by the front surface of the proximal wall 45 and the inner peripheral surface of the cylindrical wall 46. As shown in FIGS. 1 to 2B, the valve chamber 47 is provided on a front portion of the ink cartridge 30 in the front-rear direction 53 and near a bottom portion of the ink cartridge 30 in the up-down direction 52. The proximal wall 45 and cylindrical wall 46 are formed of a resin material, for example. The valve chamber 47 is connected to a first air channel 60, a second air channel 63, and a first liquid channel 66. As shown in FIGS. 5A and 5B, a second liquid channel 69 is formed in the valve chamber 47. The seal member 70 and a cap 72 are attached to the distal end of the cylindrical wall 46. The valve element 77, the seal member 82, and a coil spring 86 (an example of a first biasing member of the invention) are all accommodated within the cylindrical wall 46.

Figure 2A:
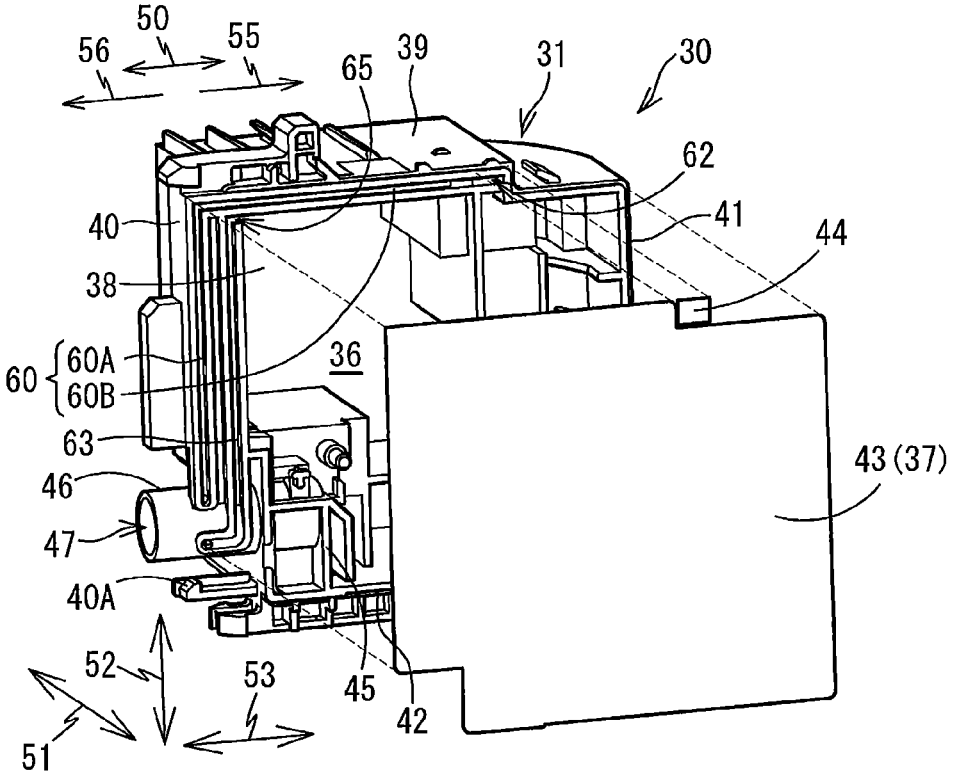
FIG. 2A is a right side perspective view showing a structure of an ink cartridge according to the first embodiment from an upper front perspective.
Figure 2B:
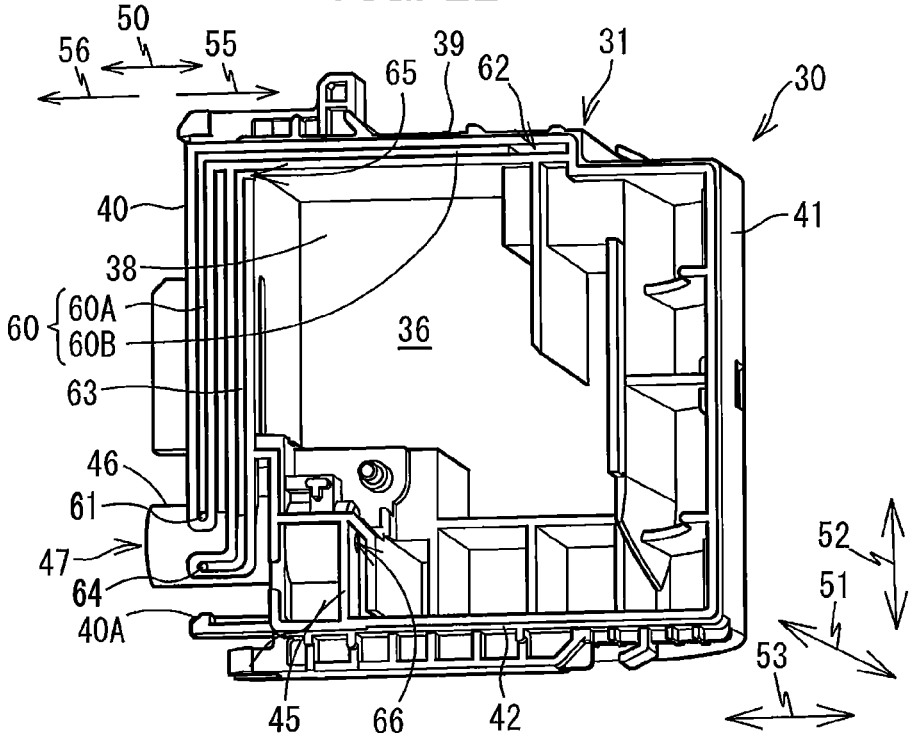
FIG. 2B is a right side perspective view showing the structure of the ink cartridge according to the first embodiment from a lower rear perspective.

As shown in FIGS. 2A and 2B, the proximal wall 45 is disposed between the ink chamber 36 and valve chamber 47 that are adjacent to each other in the front-rear direction 53. The cylindrical wall 46 extends forward from the front surface of the proximal wall 45. In other words, the cylindrical wall 46 extends from the front surface of the proximal wall 45 in the mounting direction 56 toward the outside of the ink cartridge 30. The front end of the cylindrical wall 46 protrudes forward from the front wall 40, while the rear end is positioned rearward of the front wall 40. The proximal end of the cylindrical wall 46 (an upstream end in the mounting direction 56; an example of a first end of the invention) is connected to the proximal wall 45, and the distal end of the cylindrical wall 46 (a downstream end in the mounting direction 56; an example of a second end of the invention) is open. The inner peripheral surface of the cylindrical wall 46 is formed continuously in a cross section orthogonal to the mounting direction 56, i.e., is annular. The inner peripheral surface of the cylindrical wall 46 is an example of a side wall surface of the invention. The inner peripheral surface of the cylindrical wall 46 has a cross section taken orthogonally to the mounting direction 56 that is elliptical in shape, with its major axis aligned in the up-down direction 52. Note that the cross section of the inner peripheral surface of the cylindrical wall 46 taken orthogonally to the mounting direction 56 is not limited to an elliptical shape, but may be circular or rectangular in shape, for example, provided that the cross-sectional shape is annular. However, it is preferable that the cross-sectional shape of the cylindrical wall 46 be non-circular, as will be described later. The front surface of the proximal wall 45 is an example of a proximal wall surface. Therefore, the proximal end of the cylindrical wall 46 serving as an example of the first end indicates the upstream end of the mounting direction 56 on the inner peripheral surface of the cylindrical wall 46. The distal end of the cylindrical wall 46 serving as an example of the second end of the invention indicates the downstream end in the mounting direction 56 on the inner peripheral surface of the cylindrical wall 46.

The first air channel 60 allows air to flow between the valve chamber 47 and the exterior of the ink cartridge 30. In other words, the first air channel 60 provides communication between the valve chamber 47 and ambient air. Referring to FIGS. 3A and 3B, the first air channel 60 includes a groove 60A and a groove 60B. The groove 60A is formed in a right endface of the front wall 40 and extends in the up-down direction 52. The groove 60B is formed in a right endface of the top wall 39 and extends in the front-rear direction 53 so as to be connected with a top end of the groove 60A. The bottom end of the groove 60A is in communication with the valve chamber 47 through the opening 61 (an example of a first opening of the invention; also see FIG. 5B) formed in the inner peripheral surface (i.e., the side wall surface) of the cylindrical wall 46. The rear end of the groove 60B is in communication with the exterior of the ink cartridge 30 through an opening 62 formed in the right endface of the top wall 39.

The second air channel 63 allows air to flow between the valve chamber 47 and ink chamber 36. The second air channel 63 is a groove formed in the right endface of the front wall 40 that extends in the up-down direction 52. Further, the second air channel 63 has a bottom end that is bent in the mounting direction 56 and that is in communication with the valve chamber 47 through the opening 64 (an example of a second opening of the invention; also see FIG. 5B) formed in the inner peripheral surface of the cylindrical wall 46. The top end of the second air channel 63 is in communication with the ink chamber 36 through an opening 65 formed in a rear surface of the front wall 40 (the surface on the ink chamber 36 side).

As shown in FIG. 5B, the openings 61 and 64 are arranged at positions separated in a circumferential direction along the inner peripheral surface of the cylindrical wall 46 and at least partially overlapping the same plane orthogonal to the mounting direction 56. In the present embodiment, the openings 61 and 64 are disposed in the same position with respect to the mounting and removing directions 50. The opening 65 is positioned above the level of ink accommodated in the ink chamber 36 of the ink cartridge 30 that is still unused.

As shown in FIG. 2A, the first air channel 60 and second air channel 63 are sealed liquid-tight by the film 43 constituting the right wall 37 of the ink cartridge 30. The opening 62 is also sealed by a semipermeable membrane 44. That is, a notch is formed in the film 43 at a position corresponding to the opening 62. The semipermeable membrane 44 is a porous membrane formed with microholes that allow the passage of air while preventing the passage of ink. For example, the semipermeable membrane 44 may be formed of a fluororesin, such as polytetrafluoroethylene, tetrafluoroethylenehexafluoropropylene copolymer, tetrafluoroethylene-perfluoroalkyl vinyl ether copolymer, or tetrafluoroethylene-ethylene copolymer.

As shown in FIGS. 5A and 5B, the first liquid channel 66 allows ink to flow between the proximal wall 45 side of the valve chamber 47 and the ink chamber 36. In the present embodiment, the first liquid channel 66 is a through-hole that penetrates the proximal wall 45 in its thickness dimension (in the front-rear direction 53 or mounting and removing directions 50). The first liquid channel 66 is in communication with the valve chamber 47 through an opening 67 (an example of a third opening of the invention) formed in the front surface (surface on the valve chamber 47 side) of the proximal wall 45. Thus, the opening 67 is positioned toward the proximal end of the cylindrical wall 46 from the opening 61 and opening 64. The first liquid channel 66 is in communication with the ink chamber 36 through an opening 68 formed in a rear surface (the surface on the ink chamber 36 side) of the proximal wall 45.

Figure 3:
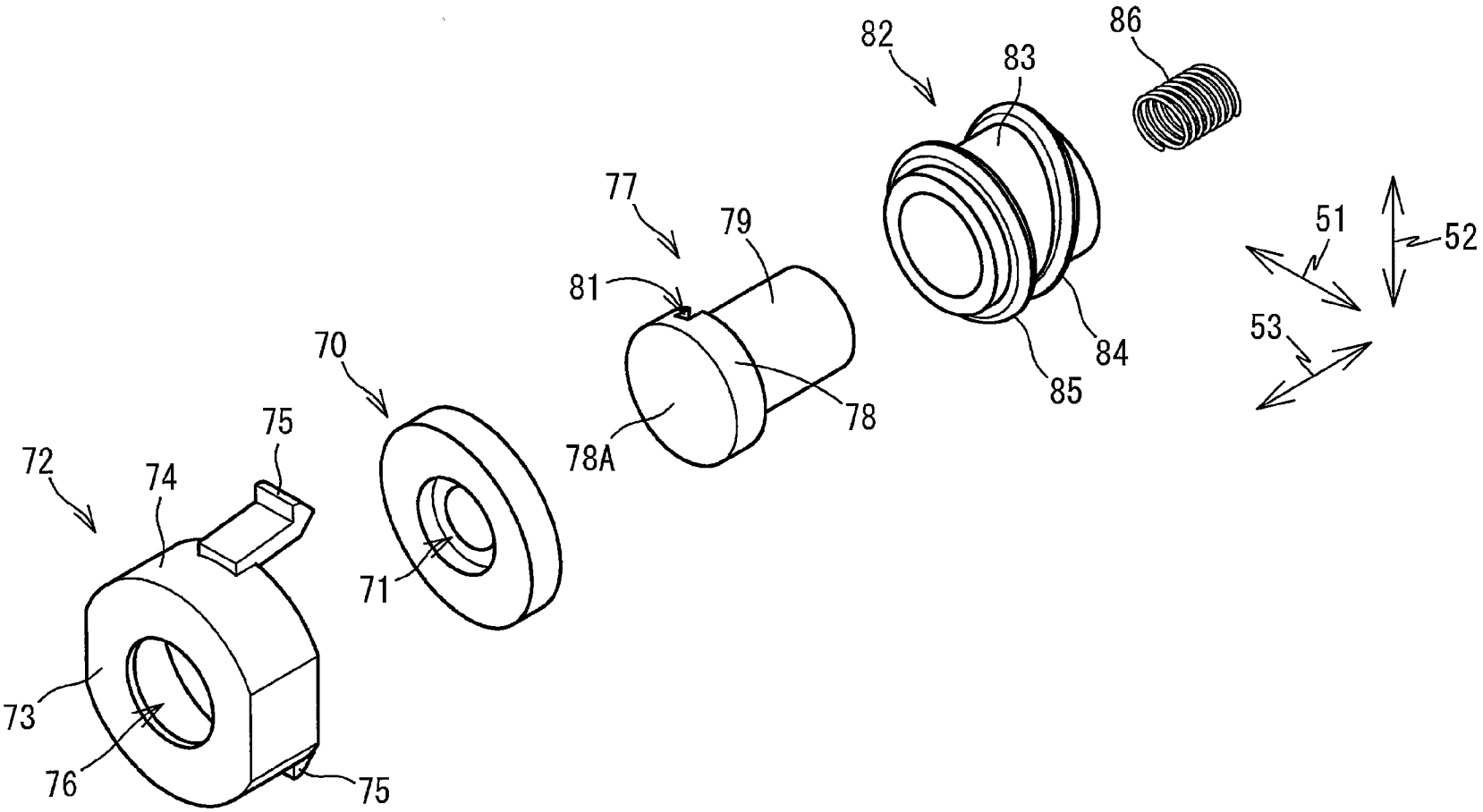
FIG. 3 is an exploded perspective view from the front side showing components that function to open and close a valve chamber in the ink cartridge according to the first embodiment, the components including a valve element and a seal member.
Figure 4:
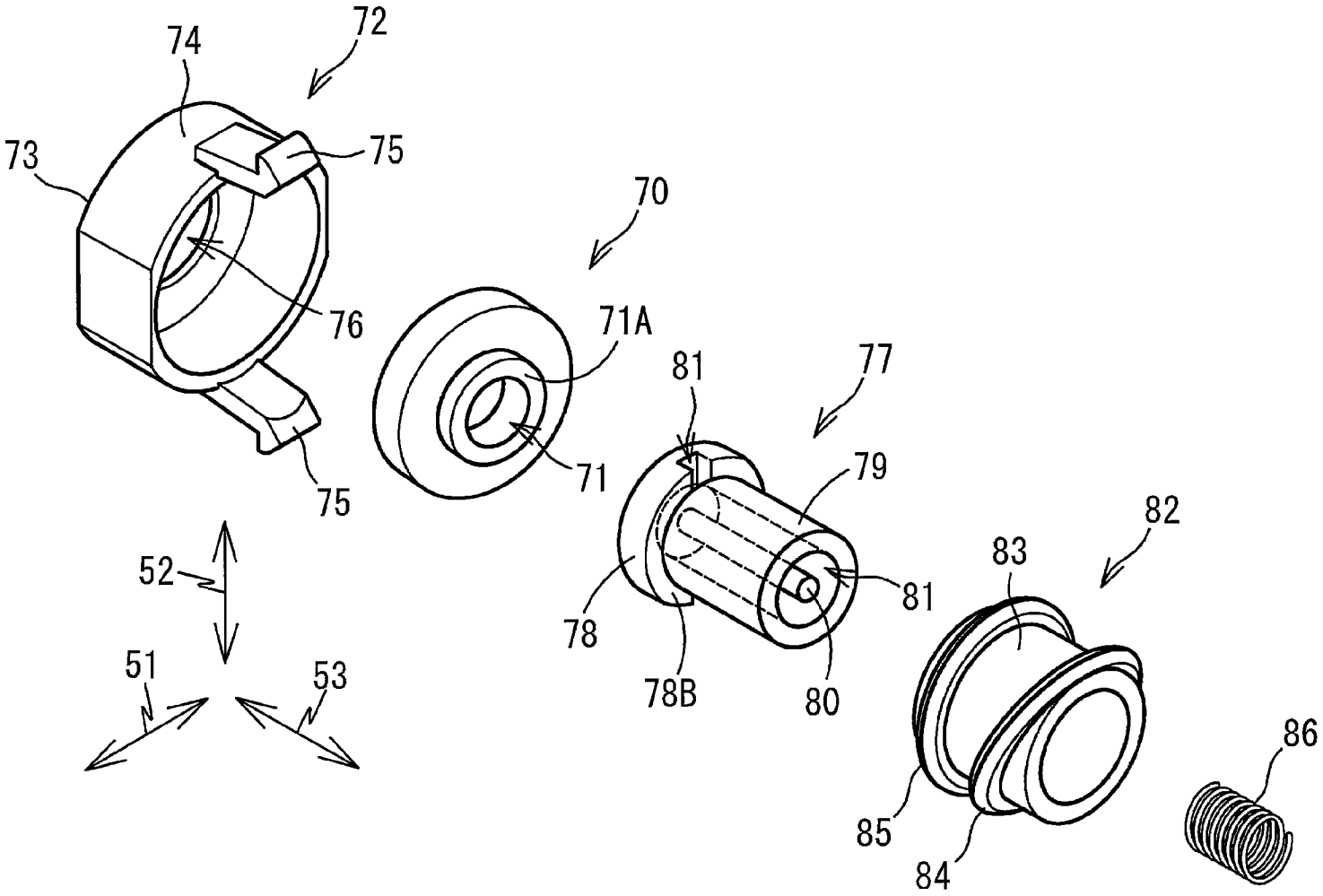
FIG. 4 is an exploded perspective view from the rear side showing the components that function to open and close the valve chamber in the ink cartridge according to the first embodiment.

As shown in FIGS. 3 and 4, the seal member 70 has a flat plate-like shape and is elliptical in a plan view with its major axis aligned in the up-down direction 52. The seal member 70 has an outer diameter substantially equivalent to that of the cylindrical wall 46. The seal member 70 is mounted on the distal end of the cylindrical wall 46 so as to be liquid-tight. A through-hole 71 is formed in the seal member 70 and penetrates a center region of the seal member 70 in its thickness dimension (in the front-rear direction 53 or mounting and removing directions 50). The through-hole 71 provides communication between the interior and exterior of the valve chamber 47. Note that the diameter of the through-hole 71 is slightly smaller than the outer diameter of the ink needle 102. A protruding part 71A is formed on the seal member 70 so as to protrude in the removing direction 55 from a peripheral edge of the through-hole 71. The protruding part 71A is an annular protrusion that is formed continuously so as to surround the through-hole 71. The protruding part 71A has an endface (an example of a contact surface of the invention) on the downstream side in the removing direction 55 that is orthogonal to the mounting direction 56 and serves to contact the valve element 77. The seal member 70 is formed of rubber or another elastic material.

As shown in FIGS. 3 and 4, the cap 72 is configured of an elliptical disc-shaped cover part 73, a cylindrical part 74 with an elliptical-shaped cross-section that protrudes from one surface (rear surface) of the cover part 73 in its thickness dimension (i.e., in the front-rear direction 53 or mounting and removing directions 50), and engaging parts 75 that protrude away from the cover part 73 from a protruding edge of the cylindrical part 74. A through-hole 76 is formed in the cover part 73 and penetrates a center region of the cover part 73 in its thickness direction. The diameter of the through-hole 76 is larger than that of the through-hole 71. The cylindrical part 74 is provided to surround the through-hole 76. The cap 72 is formed of a resin material, for example.

The cover part 73 contacts the seal member 70 from the side of the seal member 70 opposite the cylindrical wall 46. Hence, the seal member 70 is interposed between the cover part 73 and the distal end of the cylindrical wall 46 in the front-rear direction 53. The cylindrical part 74 covers the outer circumferential surface of the seal member 70 and a portion on the outer peripheral surface of the cylindrical wall 46, as shown in FIGS. 5A and 5B. The engaging parts 75 engage with engaged parts 40A provided on the front wall 40 (see FIGS. 2A and 2B). The cap 72 holds the seal member 70 on the distal end of the cylindrical wall 46.

As shown in FIGS. 3 and 4, the valve element 77 is configured of a disc-shaped valve 78, a cylindrical retaining part 79, and a protruding member 80 that protrudes from the valve 78 toward the proximal end of the cylindrical wall 46. The valve element 77 is disposed in the valve chamber 47, with the valve 78 facing the distal end of the cylindrical wall 46 and the retaining part 79 facing the proximal end of the cylindrical wall 46 and is capable of moving in the front-rear direction 53. The valve element 77 is formed of a material having greater rigidity than the seal member 82 (a resin material, for example). The valve element 77 and seal member 82 are an example of a movable body of the invention.

The valve 78 has a front surface 78A (an example of a closing part of the invention) that can tightly contact the endface of the protruding part 71A of the seal member 70, and a rear surface 78B on the opposite side of the valve 78 from the front surface 78A. The retaining part 79 and protruding member 80 protrude from the rear surface 78B. The outer dimension of the valve 78 is larger than the diameter of the through-hole 71 and smaller than the inner diameter (minor axis) of the cylindrical wall 46. The retaining part 79 protrudes from the rear surface 78B of the valve 78 at a position surrounding the protruding member 80 toward the proximal end of the cylindrical wall 46. An opening is formed in an end of the retaining part 79 facing the proximal wall 45. The retaining part 79 has an outer diameter smaller than the inner diameter (minor axis) of the cylindrical wall 46.

The protruding member 80 extends from the rear surface 78B of the valve 78 toward the proximal end of the cylindrical wall 46 and is arranged to face the opening 67 formed in the front surface of the proximal wall 45. A through-hole 81 is formed in the valve element 77. The through-hole 81 is configured of an internal space formed in the retaining part 79, and grooves that extend radially outward from this internal space along the rear surface 78B of the valve 78. The through-hole 81 is an example of a movable-body through-hole of the invention. The opening in the through-hole 81 on the proximal wall 45 side of the retaining part 79 is an example of a fourth opening of the invention, and the openings on the rear surface 78B side are an example of a fifth opening.

The seal member 82 is configured of a cylindrical part 83 that fits around the outer circumferential surface of the retaining part 79, and flange-like first and second sealing parts 84 and 85 that protrude radially outward from the outer circumferential surface of the cylindrical part 83. The seal member 82 is formed of a rubber or other elastic material, for example. The first and second sealing parts 84 and 85 are separated from each other in the front-rear direction 53. More specifically, the first sealing part 84 is provided closer to the proximal end (proximal wall 45 side) of the cylindrical wall 46 than the second sealing part 85 is, and thus conversely, the second sealing part 85 is provided nearer to the distal end of the cylindrical wall 46 than the first sealing part 84 is to the distal end of the cylindrical wall 46. The seal member 82 moves in the front-rear direction 53 within the valve chamber 47 together with the valve element 77. Through the movement of the valve element 77, the first and second sealing parts 84 and 85 slide along the inner peripheral surface of the cylindrical wall 46.

As shown in FIGS. 3 and 4, the first and second sealing parts 84 and 85 are elliptical in shape with their long axes extending in the up-down direction 52 when viewed in the front-rear direction 53. The inner peripheral surface of the cylindrical wall 46 also has an elliptical shape in a cross section taken orthogonally to the mounting direction 56, with its major axis extending in the up and down directions 52. Hence, the seal member 82 can be inserted into the internal space of the cylindrical wall 46 such that the orientation of the seal member 82 matches the inner peripheral surface of the elliptical cylindrical wall 46, i.e., such that the first and second sealing parts 84 and 85 are oriented with their major axes aligned in the up-down direction 52, and the circumferential edges of the first and second sealing parts 84 and 85 contact and form an airtight seal with the inner peripheral surface of the cylindrical wall 46. The elliptical shapes of the first and second sealing parts 84 and 85 and the elliptical shape of the inner peripheral surface of the cylindrical wall 46 are examples of a rotation restricting part of the invention.

The outer diameter of the first and second sealing parts 84 and 85 is greater than the inner diameter of the cylindrical wall 46 when the seal member 82 is not inserted in the valve chamber 47. In other words, the first and second sealing parts 84 and 85 elastically deform inward in a direction that reduces their outer diameters when contacting the inner peripheral surface of the cylindrical wall 46. Thus, the space on the proximal side of the valve chamber 47 is shutoff from the space on the distal side of the valve chamber 47 on the outside of the valve element 77. Air can circulate in the enclosed space formed between the first and second sealing parts 84 and 85.

The first sealing part 84 extends continuously around the center axis of the valve chamber 47, which is aligned in the front-rear direction 53, along a plane that intersects but is not orthogonal to the mounting direction 56. As shown in FIGS. 5A and 5B, the first sealing part 84 forms an airtight seal with the inner peripheral surface of the cylindrical wall 46 to interrupt communication in the valve chamber 47 between the openings 61 and 64 when the valve element 77 is in the first state. With this arrangement, the opening 61 is connected to the enclosed space in the valve chamber 47 between the first and second sealing parts 84 and 85, while the opening 64 is connected to the space in the valve chamber 47 on the proximal wall 45 side of the first sealing part 84.

The second sealing part 85 extends continuously around the center axis of the valve chamber 47 aligned in the front-rear direction 53 and falls in a plane orthogonal to the mounting direction 56.

The space in the valve chamber 47 on the proximal wall 45 side can communicate with the space on the distal end side of the valve chamber 47 through the through-hole 81 formed in the valve element 77. The channel extending from the opening 67 to the through-hole 71 through the through-hole 81 constitutes the second liquid channel 69 for providing ink flow through the valve chamber 47.

The coil spring 86 is disposed between the proximal wall 45 and valve element 77. More specifically, one end of the coil spring 86 contacts the front surface of the proximal wall 45, and the other end contacts the surface of the valve element 77 (more specifically, the retaining part 79) facing the proximal wall 45. The coil spring 86 biases the valve element 77 toward the distal end of the cylindrical wall 46 in order to maintain the valve element 77 in the first state (see FIGS. 5A and 5B) within the valve chamber 47 in which the valve 78 contacts the seal member 70. Note that a plate spring or other urging member may be used in place of the coil spring 86.

<Operations for Mounting the Ink Cartridge 30 in the Cartridge-Mounting Unit 110>

Next, the movement of the valve element 77 during the process of mounting the ink cartridge 30 in the cartridge-mounting unit 110 will be described with reference to FIGS. 5A through 7B.

Prior to the ink cartridge 30 being mounted in the cartridge-mounting unit 110, the valve element 77 and seal member 82 are in the first state shown in FIGS. 5A and 5B. In the first state, the valve element 77 is made to contact the seal member 70 by the biasing force of the coil spring 86. More specifically, when the valve element 77 and seal member 82 are in this first state, the front surface 78A of the valve 78 contacts the protruding part 71A at the peripheral region of the through-hole 71 formed in the seal member 70 to form a liquid-tight seal with the protruding part 71A. Thus, the valve 78 blocks the through-hole 71. The first liquid channel 66 and second liquid channel 69 are in communication with each other, but the second liquid channel 69 is sealed off from the outside of the valve chamber 47 at the through-hole 71.

The first sealing part 84 extends between the openings 61 and 64 along a plane that obliquely intersects but is not orthogonal to the front-rear direction 53. With this arrangement, the first sealing part 84 interrupts communication between the first and second air channels 60 and 63. Note that the first sealing part 84 may be arranged to overlap a portion of the openings 61 and 64, provided that communication is interrupted between the first and second air channels 60 and 63. The second sealing part 85 contacts and forms an airtight seal with the inner peripheral surface of the cylindrical wall 46 at a position toward the distal end of the cylindrical wall 46 from the opening 61. In this way, the second sealing part 85 interrupts communication between the first air channel 60 and the through-hole 71. The second sealing part 85 may also overlap a portion of the opening 61, provided that communication is interrupted between the first air channel 60 and through-hole 71.

FIGS. 6A and 6B show the state of components in the valve chamber 47 as the ink cartridge 30 is being mounted in the cartridge-mounting unit 110 (as the ink needle 102 is being inserted into the valve chamber 47). When the ink cartridge 30 is in the process of being mounted into the cartridge-mounting unit 110, the valve element 77 and seal member 82 move against the biasing force of the coil spring 86 toward the proximal wall 45 side of the cylindrical wall 46 (in the removing direction 55) from the first state toward a second state shown in FIG. 7 due to pressure from the ink needle 102 inserted into the valve chamber 47 through the through-hole 76 and through-hole 71.

When the valve element 77 and seal member 82 are in the second state, the front surface 78A of the valve 78 is separated from the seal member 70. At this time, the third sealing part 105 and the communication holes 104 on the distal end 103 of the ink needle 102 are inserted into the through-hole 71 of the seal member 70 and pressed against the seal member 70, but the communication holes 104 have not yet advanced into the valve chamber 47 beyond the through-hole 71. That is, the third sealing part 105 of the ink needle 102 contacts an inner circumferential surface (peripheral surface) of the seal member 70 defining the through-hole 71, causing the inner circumferential surface to elastically deform in a radial direction thereof, and part of the distal end of the third sealing part 105 has advanced into the valve chamber 47, but the communication holes 104 are still sealed by the inner circumferential surface of the seal member 70 at the through-hole 71. Therefore, while the front surface 78A of the valve 78 is separated from the seal member 70, the valve chamber 47 and the internal space of the ink needle 102 are not in communication with each other.

When the valve element 77 and seal member 82 are in the second state, the first sealing part 84 is positioned between the opening 67 and the openings 61, 64. Specifically, the first sealing part 84 contacts and forms an airtight seal with the inner peripheral surface of the cylindrical wall 46 at a position toward the proximal wall 45 side of the cylindrical wall 46 from the openings 61, 64 and toward the distal end of the cylindrical wall 46 from the opening 67. Thus, the first sealing part 84 allows communication between the first air channel 60 and second air channel 63, but interrupts communication between the second air channel 63 and first liquid channel 66. Therefore, the ink chamber 36 is in communication with external air through the first air channel 60, the enclosed space between the first and second sealing parts 84 and 85 (the valve chamber 47), and the second air channel 63. The second sealing part 85 contacts and forms an airtight seal with the inner peripheral surface of the cylindrical wall 46 at a position toward the distal end of the cylindrical wall 46 from the openings 61, 64. Accordingly, the second sealing part 85 interrupts communication between the first and second air channels 60 and 63 and the through-hole 71.

Figure 7A:
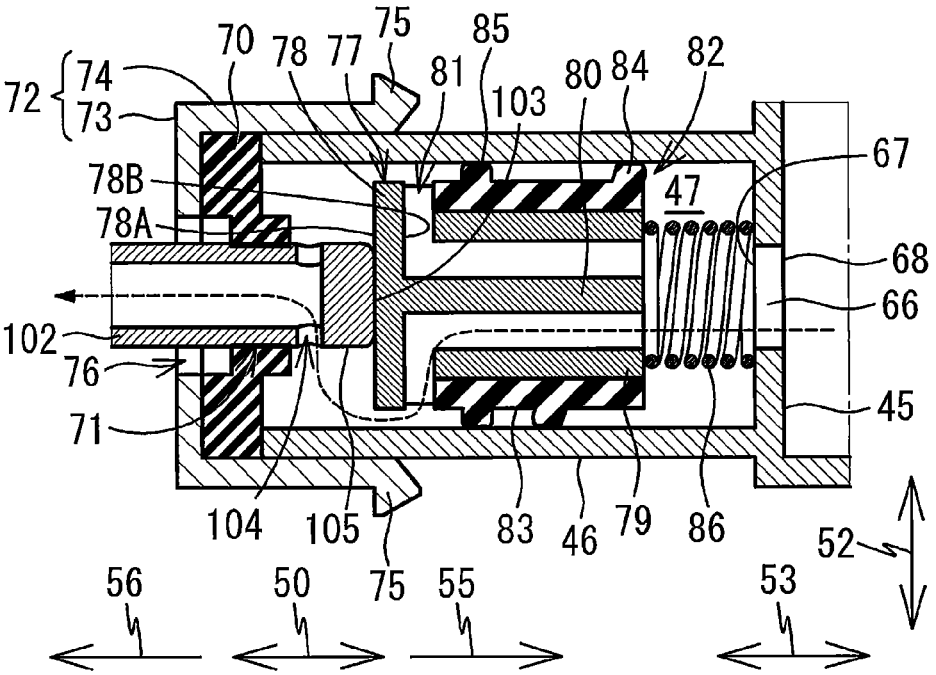
FIG. 7A is an enlarged cross-sectional view of the valve chamber in a vertical cross section of the ink cartridge according to the first embodiment viewed from its right side when the valve element and seal member are in a third state.
Figure 7B:
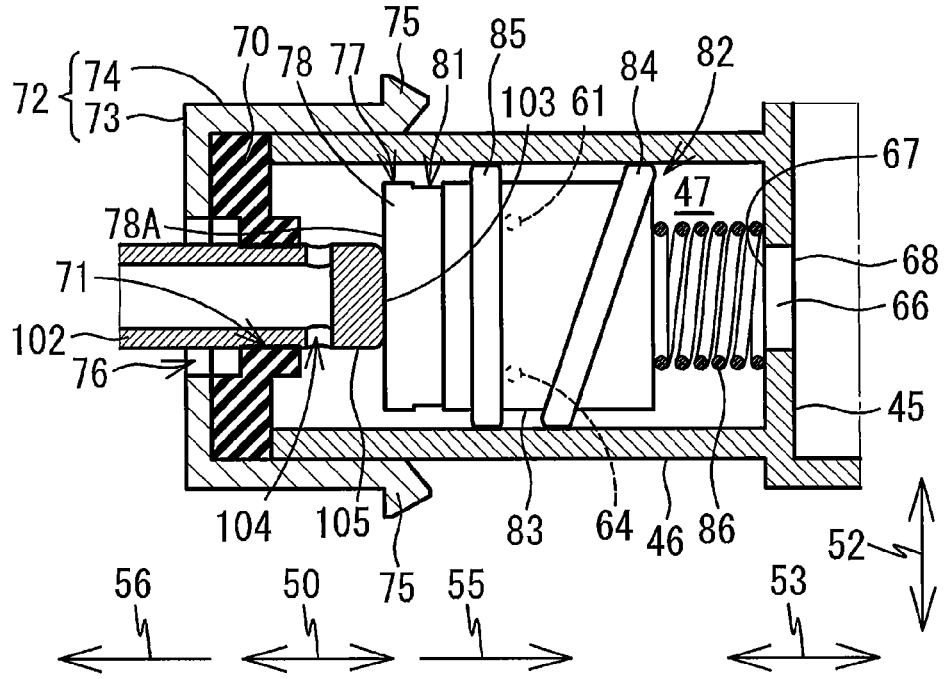
FIG. 7B is an enlarged cross-sectional view of the valve chamber in the vertical cross section of the ink cartridge according to the first embodiment viewed from its right side when the valve element and seal member are in the third state, wherein the valve element and seal member are shown as a side view and the openings of the valve chamber are indicated by broken lines.

FIGS. 7A and 7B show the state of components in the valve chamber 47 once the ink cartridge 30 has been completely mounted in the cartridge-mounting unit 110 (in a state where ink can be supplied from the ink cartridge 30). When the ink cartridge 30 is completely mounted in the cartridge-mounting unit 110, the valve element 77 and seal member 82 are in a third state closer to the proximal end of the cylindrical wall 46 than in the second state. In this third state, the ink needle 102 has been inserted farther into the valve chamber 47, pressing the valve element 77 and seal member 82 farther toward the proximal end of the cylindrical wall 46 against the biasing force of the coil spring 86.

When the valve element 77 and seal member 82 are in this third state, the front surface 78A of the valve 78 is separated from the seal member 70, the ink needle 102 is inserted farther through the through-hole 71 of the seal member 70, and both the third sealing part 105 and communication holes 104 have advanced past the through-hole 71 into the valve chamber 47. Consequently, the second liquid channel 69 is in communication with the internal space (liquid channel) in the ink needle 102 through the valve chamber 47 and through-hole 71. The ink in the ink chamber 36 is thus allowed to flow out of the ink cartridge 30 through the first liquid channel 66, second liquid channel 69, and the ink needle 102.

At this time, the first sealing part 84 is positioned between the openings 61, 64 and opening 67. Specifically, the first sealing part 84 contacts and forms an airtight seal with the inner peripheral surface of the cylindrical wall 46 at a position toward the proximal end of the cylindrical wall 46 from the openings 61, 64 and toward the distal end of the cylindrical wall 46 from the opening 67. Accordingly, the first sealing part 84 allows communication between the first and second air channels 60 and 63, while interrupting communication between the second air channel 63 and first liquid channel 66. Hence, the ink chamber 36 is in communication with external air through the first air channel 60, the enclosed space between the first and second sealing parts 84 and 85 (the valve chamber 47), and the second air channel 63. The second sealing part 85 also contacts and forms an airtight seal with the inner peripheral surface of the cylindrical wall 46 at a position toward the distal end of the cylindrical wall 46 from the openings 61, 64. Accordingly, the second sealing part 85 interrupts communication between the first and second air channels 60 and 63 and the through-hole 71.

<Operational Advantages of the First Embodiment>

According to the configuration of the first embodiment described above, the front surface 78A of the valve element 77 closes off the through-hole 71 formed in the seal member 70 when the valve element 77 and seal member 82 are in the first state, preventing ink from flowing out of the ink cartridge 30. The ink chamber 36 is also an enclosed space at this time. When the valve element 77 and seal member 82 are in the second state, the ink chamber 36 is in communication with external air through the first air channel 60, the enclosed space between the first and second sealing parts 84 and 85 (the valve chamber 47), and the second air channel 63. However, the third sealing part 105 is in close contact with the seal member 70, and the communication holes 104 are blocked by the same. Since the communication holes 104 have not advanced into the valve chamber 47, the ink chamber 36 is not in communication with the internal space of the ink needle 102. When the valve element 77 and seal member 82 are in the third state, the third sealing part 105 has separated from the seal member 70, and the communication holes 104 have advanced into the valve chamber 47. At this time, the ink chamber 36 is in communication with the internal space of the ink needle 102 through the first liquid channel 66, second liquid channel 69, valve chamber 47, and communication holes 104. Since the openings 61 and 64 are spaced apart in the circumferential direction along the inner peripheral surface of the cylindrical wall 46 and are disposed in positions that at least partially fall in the same plane orthogonal to the mounting direction 56, the dimension of the valve chamber 47 in the mounting direction 56 can be made shorter than a configuration in which the openings 61 and 64 are spaced apart from each other in the mounting direction 56.

Further, giving the first and second sealing parts 84 and 85 an elliptical shape when viewed in the front-rear direction 53 and giving the inner peripheral surface of the cylindrical wall 46 an elliptical shape in a cross section orthogonal to the mounting direction 56 restricts the seal member 82 from rotating in its circumferential direction within the valve chamber 47. Accordingly, the positional relationship of the first sealing part 84 to the openings 61 and 64 will not change due to rotation of the seal member 82.

Further, since the ink needle 102 contacts the front surface 78A of the valve element 77 and pushes the valve element 77 in the removing direction 55 relative to the seal member 70, the valve element 77 moves in the removing direction 55 against the biasing force of the coil spring 86. When the ink needle 102 separates from the front surface 78A, the biasing force of the coil spring 86 moves the valve element 77 in the mounting direction 56. Accordingly, when the ink needle 102 is extracted from the through-hole 71 of the seal member 70, the through-hole 71 is contacted by the front surface 78A of the valve element 77 and immediately blocked by the same.

Further, since the protruding part 71A of the seal member 70 receives the biasing force of the coil spring 86, the coil spring 86 remains in a compressed state from its natural length and can maintain the valve element 77 in the first state. This configuration allows the valve chamber 47 to be more compact.

Further, by providing the first and second liquid channels 66 and 69, the ink channel from the ink chamber 36 to the seal member 70 can be made simple and short.

By forming the opening 67 in the proximal wall 45, the first sealing part 84 will not move further toward the proximal wall 45 than the opening 67. Thus, the moving range of the valve element 77 and seal member 82 can be set without consideration for the positional relationship of the first sealing part 84 and opening 67.

2. Second Embodiment

A configuration according to a second embodiment of the present invention will be described next with reference to FIGS. 8A through 10B.

In the first embodiment described above, the ink needle 102 is provided with the third sealing part 105, but the third sealing part 105 is not provided on an ink needle 202 of the second embodiment. Instead, a third sealing part 287 is provided on a valve 278 of a valve element 277 of the second embodiment. The remaining structures in the second embodiment are generally the same as the structures in the first embodiment and, hence, a detailed description therefor has been omitted. Parts and components in FIGS. 8A through 10B having the same reference numerals used in the first embodiment have the same structures as these components in the first embodiment.

Figure 9A:
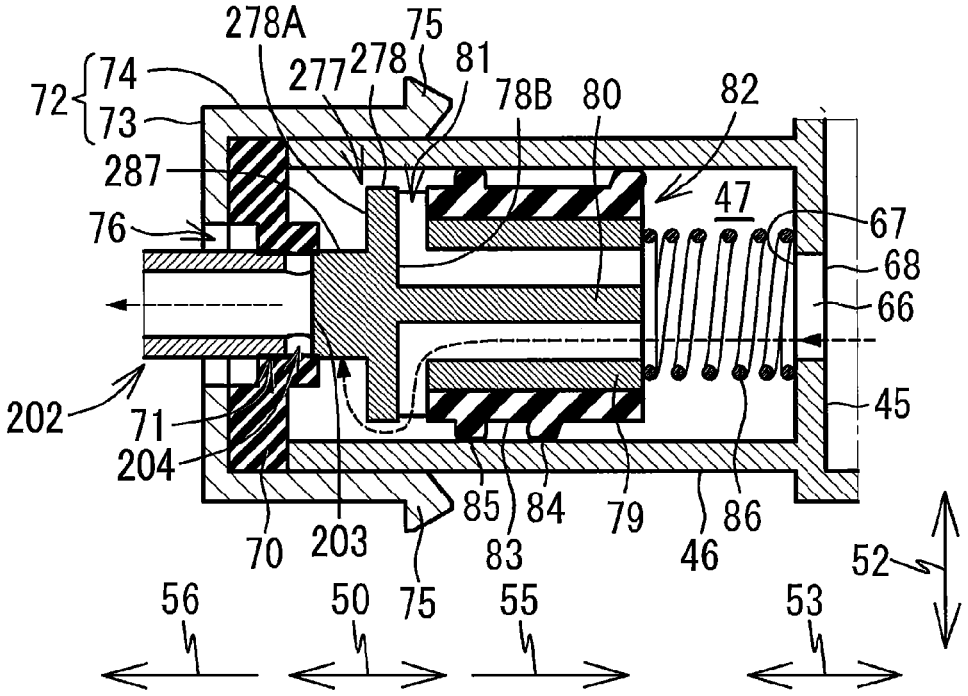
FIG. 9A is an enlarged cross-sectional view of the valve chamber in a vertical cross section of the ink cartridge according to the second embodiment viewed from its right side when the valve element and seal member are in a second state.
Figure 9B:
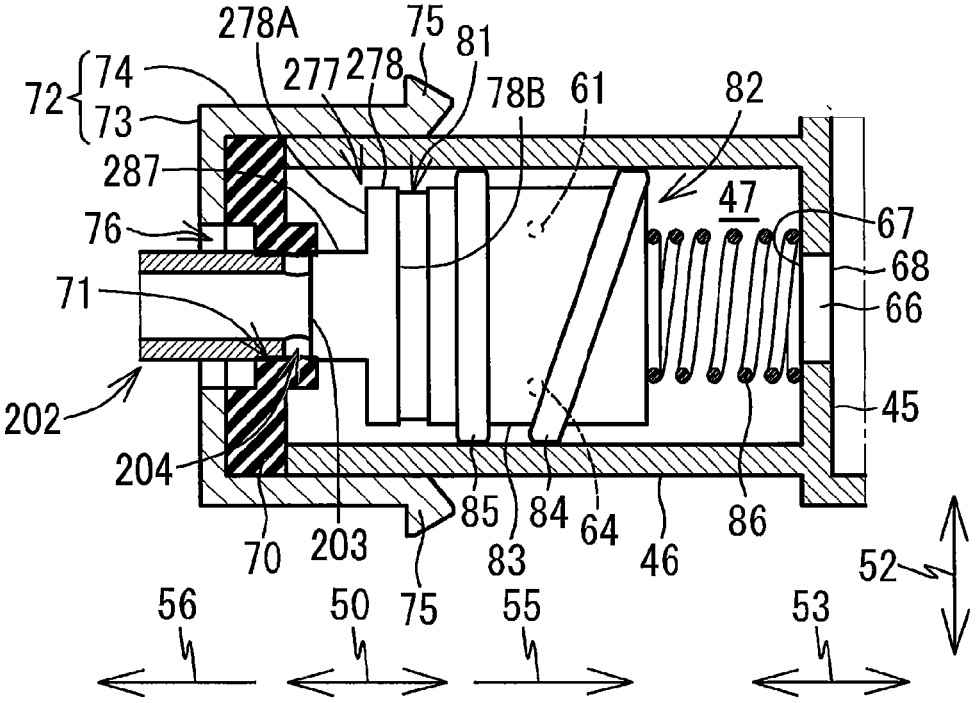
FIG. 9B is an enlarged cross-sectional view of the valve chamber in the vertical cross section of the ink cartridge according to the second embodiment viewed from its right side when the valve element and seal member are in the second state, wherein the valve element and seal member are shown as a side view and the openings of the valve chamber are indicated by broken lines.

More specifically, as shown in FIGS. 9A and 9B, the ink needle 202 of the second embodiment is not provided with the third sealing part 105 on a distal end 203 of the ink needle 202, and communication holes 204 are formed in a circumferential wall of the distal end 203 of the ink needle 202. In other words, in the second embodiment, the communication holes 204 are positioned closer to the distal end 203 than the communication holes 104 are to the distal end 103. Accordingly, there is no, or almost no, circumferential wall between the distal end 203 of the ink needle 202 and the communication holes 204. Thus, the length of the ink needle 202 in the mounting and removing directions 50 between the distal end 203 and communication holes 204 is shorter than the distance between the first sealing part 84 and opening 64 in the mounting and removing directions 50 when the valve element 277 and seal member 82 are in the first state. Further, the distance by which the ink needle 202 protrudes in the removing direction 55 from the inner back surface of the case 101 constituting the cartridge-mounting unit 110 is shorter than the protruding length of the ink needle 102 of the first embodiment by the dimension of the third sealing part 105.

Figure 8A:
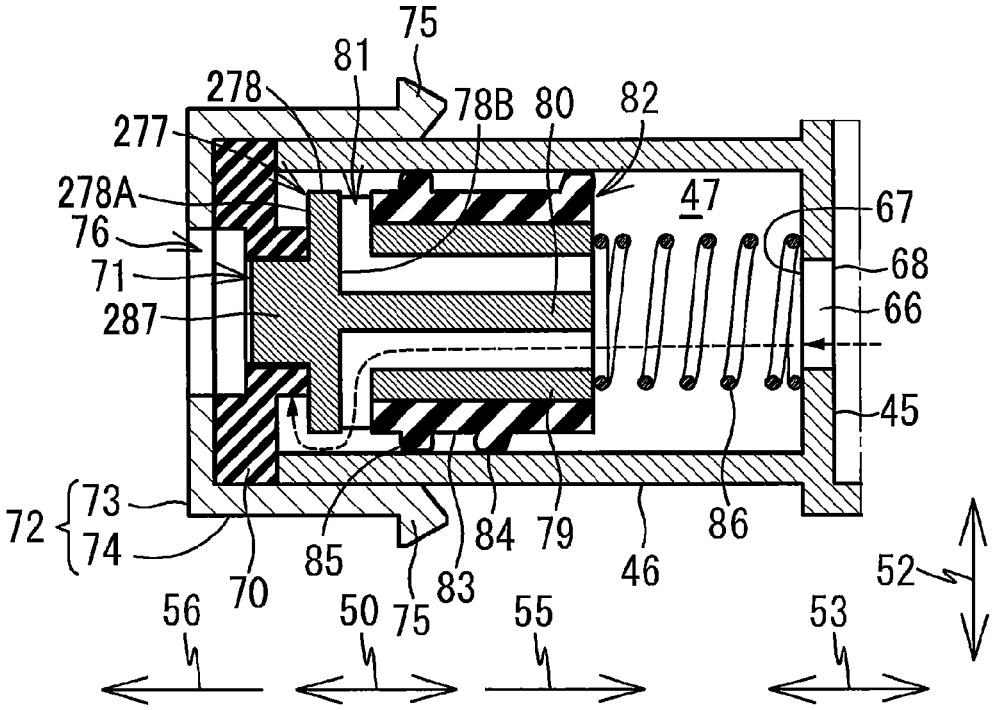
FIG. 8A is an enlarged cross-sectional view of a valve chamber in a vertical cross section of an ink cartridge according to a second embodiment viewed from its right side when a valve element and a seal member are in a first state.
Figure 8B:
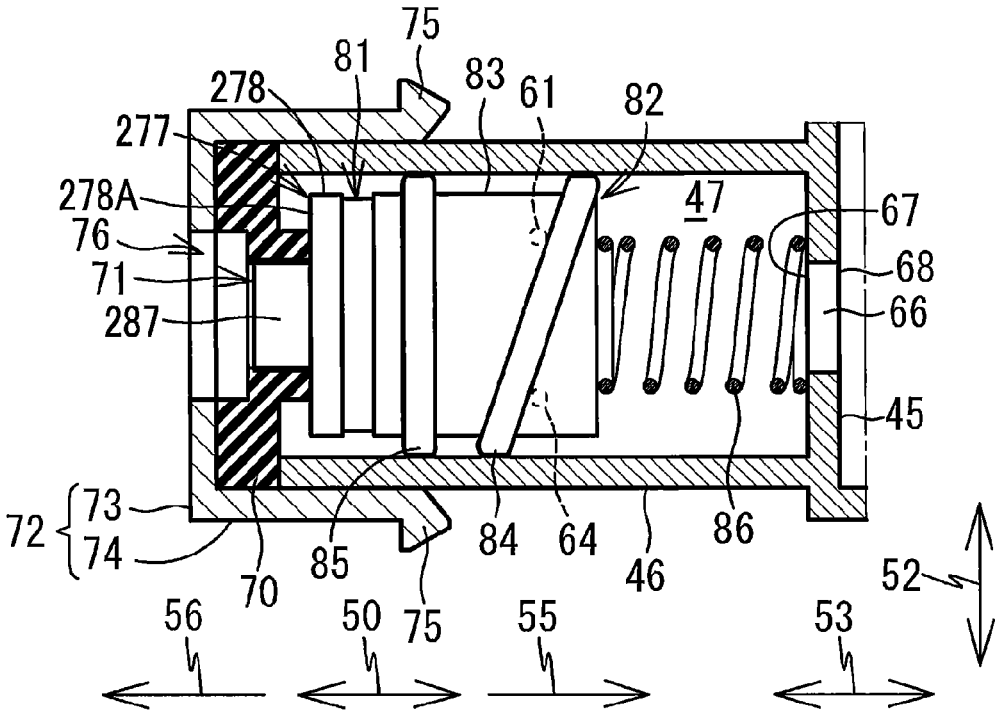
FIG. 8B is an enlarged cross-sectional view of the valve chamber in the vertical cross section of the ink cartridge according to the second embodiment viewed from its right side when the valve element and seal member are in the first state, wherein the valve element and seal member are shown as a side view and openings formed in the valve chamber are indicated by broken lines.

As shown in FIGS. 8A and 8B, the valve element 277 is provided with the third sealing part 287 that protrudes in the mounting direction 56 from a front surface 278A of the valve 278, while the front surface 278A is capable of forming a liquid-tight seal with the distal end of the protruding part 71A protruding from the seal member 70. The third sealing part 287 has a columnar shape, with an outer diameter (outer dimension) slightly larger than the inner diameter of the through-hole 71 formed in the seal member 70. Therefore, when the third sealing part 287 is inserted into the through-hole 71 of the seal member 70, the third sealing part 287 contacts the inner circumferential surface of the seal member 70 defining the through-hole 71 to form a liquid-tight seal in the through-hole 71. The dimension of the third sealing part 287 in the mounting and removing directions 50 is greater than the distance in the mounting and removing directions 50 between the first sealing part 84 and opening 64 when the valve element 277 and seal member 82 are in the first state, and shorter than the distance in the mounting and removing directions 50 between the second sealing part 85 and opening 61 when the valve element 277 and seal member 82 are in the first state.

Prior to the ink cartridge 30 being mounted in the cartridge-mounting unit 110, the valve element 277 and seal member 82 are in the first state shown in FIGS. 8A and 8B. In the first state, the valve element 277 is made to contact the seal member 70 by the biasing force of the coil spring 86. Further, the third sealing part 287 is inserted into the through-hole 71 of the seal member 70 and forms a liquid-tight seal with the inner circumferential surface defining the through-hole 71. More specifically, when the valve element 277 and seal member 82 are in this first state, the front surface 278A of the valve 278 contacts the protruding part 71A at the peripheral region of the through-hole 71 formed in the seal member 70 and forms a liquid-tight seal with the protruding part 71A. Thus, the valve 278 blocks the through-hole 71. While the first liquid channel 66, and second liquid channel 69 are in communication with each other, the second liquid channel 69 is sealed off from the outside of the valve chamber 47 at the through-hole 71.

At this time, the first sealing part 84 is positioned between the openings 61 and 64. With this arrangement, the first sealing part 84 interrupts communication between the first and second air channels 60 and 63. The second sealing part 85 contacts and forms an airtight seal with the inner peripheral surface of the cylindrical wall 46 at a position toward the distal end of the cylindrical wall 46 from the opening 61. In this way, the second sealing part 85 interrupts communication between the first air channel 60 and the through-hole 71.

FIGS. 9A and 9B show the state of components in the valve chamber 47 as the ink cartridge 30 is being mounted in the cartridge-mounting unit 110 (as the ink needle 202 is being inserted into the through-hole 71 of the seal member 70). When the ink cartridge 30 is in the process of being mounted into the cartridge-mounting unit 110, the valve element 277 and seal member 82 move against the biasing force of the coil spring 86 toward the proximal wall 45 side of the cylindrical wall 46 (in the removing direction 55) from the first state toward a second state due to pressure from the ink needle 202 inserted into the valve chamber 47 through the through-holes 76 and 71.

When the valve element 277 and seal member 82 are in the second state, the front surface 278A of the valve 278 is separated from the seal member 70. However, a portion of the third sealing part 287 remains inserted in the through-hole 71 of the seal member 70. Accordingly, the communication holes 204 formed in the distal end 203 of the ink needle 202 have advanced into the through-hole 71 of the seal member 70 and are pressed against the seal member 70, but the communication holes 204 have not yet advanced into the valve chamber 47 past the through-hole 71. That is, the through-hole 71 is still sealed because a portion of the third sealing part 287 provided on the valve 278 contacts the inner circumferential surface of the seal member 70 defining the through-hole 71. Therefore, while the front surface 278A of the valve 278 is separated from the seal member 70, the valve chamber 47 and the internal space of the ink needle 202 are not in communication with each other.

When the valve element 277 and seal member 82 are in the second state, the first sealing part 84 is positioned between the openings 61, 64 and the opening 67. Specifically, the first sealing part 84 contacts and forms an airtight seal with the inner peripheral surface of the cylindrical wall 46 at a position toward the proximal wall 45 side of the cylindrical wall 46 from the openings 61, 64 and toward the distal end of the cylindrical wall 46 from the opening 67. Thus, the first sealing part 84 allows communication between the first air channel 60 and second air channel 63, but interrupts communication between the second air channel 63 and first liquid channel 66. Therefore, the ink chamber 36 is in communication with external air through the first air channel 60, the enclosed space between the first and second sealing parts 84 and 85 (the valve chamber 47), and the second air channel 63. The second sealing part 85 contacts and forms an airtight seal with the inner peripheral surface of the cylindrical wall 46 at a position toward the distal end of the cylindrical wall 46 from the openings 61, 64. Accordingly, the second sealing part 85 interrupts communication between the first and second air channels 60 and 63 and the through-hole 71.

Figure 10A:
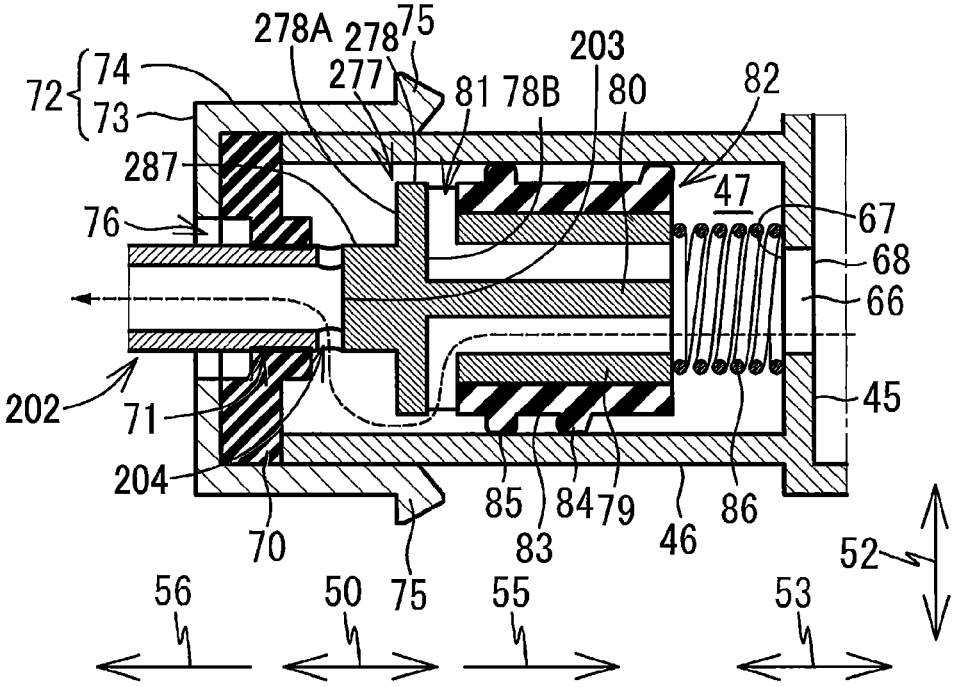
FIG. 10A is an enlarged cross-sectional view of the valve chamber in a vertical cross section of the ink cartridge according to the second embodiment viewed from its right side when the valve element and seal member are in a third state.
Figure 10B:
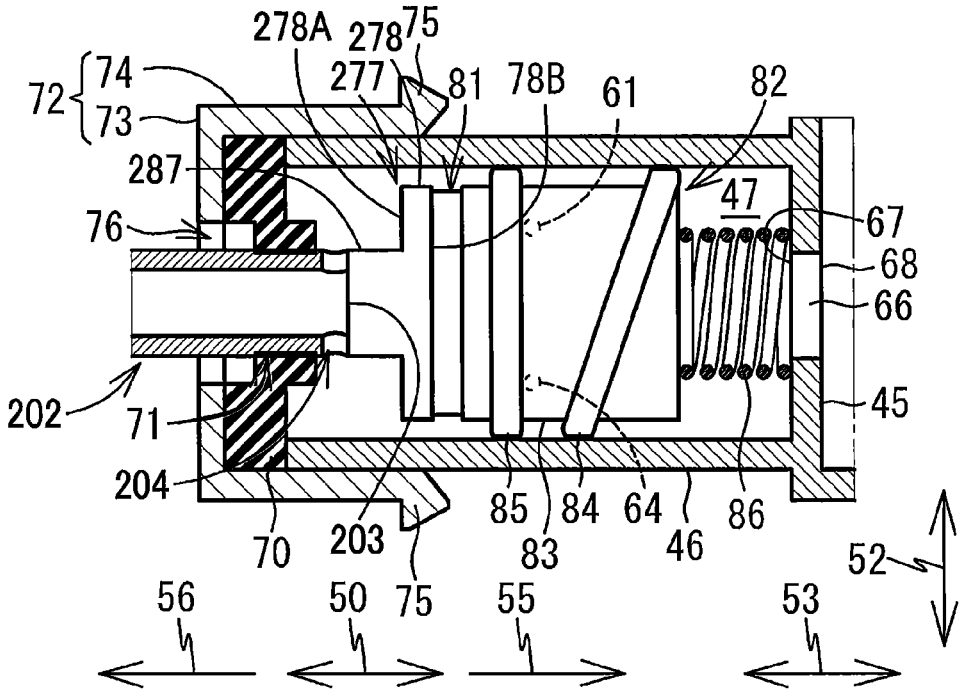
FIG. 10B is an enlarged cross-sectional view of the valve chamber in the vertical cross section of the ink cartridge according to the second embodiment viewed from its right side when the valve element and seal member are in the third state, wherein the valve element and seal member are shown as a side view and the openings of the valve chamber are indicated by broken lines.

FIGS. 10A and 10B show the state of components in the valve chamber 47 once the ink cartridge 30 has been completely mounted in the cartridge-mounting unit 110 (when ink can be supplied from the ink cartridge 30). When the ink cartridge 30 is completely mounted in the cartridge-mounting unit 110, the valve element 277 and seal member 82 are in a third state closer to the proximal end of the cylindrical wall 46 than in the second state. In this third state, the ink needle 202 has been inserted farther into the valve chamber 47, pressing the valve element 727 and seal member 82 farther toward the proximal end of the cylindrical wall 46 against the biasing force of the coil spring 86.

When the valve element 277 and seal member 82 are in this third state, the front surface 278A of the valve 278 is separated from the seal member 70, and the third sealing part 287 is completely extracted from the through-hole 71 formed in the seal member 70. At this time, the ink needle 202 is inserted farther through the through-hole 71 of the seal member 70 so that the communication holes 204 have passed the through-hole 71 and advanced into the valve chamber 47. Consequently, the second liquid channel 69 is in communication with the liquid channel in the ink needle 202 through the communication holes 204, allowing ink in the ink chamber 36 to flow out of the ink cartridge 30 through the first liquid channel 66, second liquid channel 69, and ink needle 202.

At this time, the first sealing part 84 is positioned between the openings 61, 64 and the opening 67. Specifically, the first sealing part 84 contacts and forms an airtight seal with the inner peripheral surface of the cylindrical wall 46 at a position toward the proximal end of the cylindrical wall 46 from the openings 61, 64 and toward the distal end of the cylindrical wall 46 from the opening 67. Accordingly, the first sealing part 84 allows communication between the first and second air channels 60 and 63, while interrupting communication between the second air channel 63 and first liquid channel 66. Hence, the ink chamber 36 is in communication with external air through the first air channel 60, the enclosed space between the first and second sealing parts 84 and 85 (the valve chamber 47), and the second air channel 63. The second sealing part 85 also contacts and forms an airtight seal with the inner peripheral surface of the cylindrical wall 46 at a position toward the distal end of the cylindrical wall 46 from the openings 61, 64. Accordingly, the second sealing part 85 interrupts communication between the first and second air channels 60 and 63 and the through-hole 71.

The second embodiment described above can obtain the same operational advantages described in the first embodiment.

3. Variations of the Second Embodiment

The third sealing part 287 that protrudes from the valve 278 is configured to be inserted into the through-hole 71 of the seal member 70 in the second embodiment described above. However, instead of the third sealing part 287 provided on the valve 278, a cylindrical seal part 88M may be provided on a seal member 70M in a variation of the second embodiment. Thus, a valve 78M of a valve element 77M of this variation is not provided with the third sealing part.

Figure 11A:
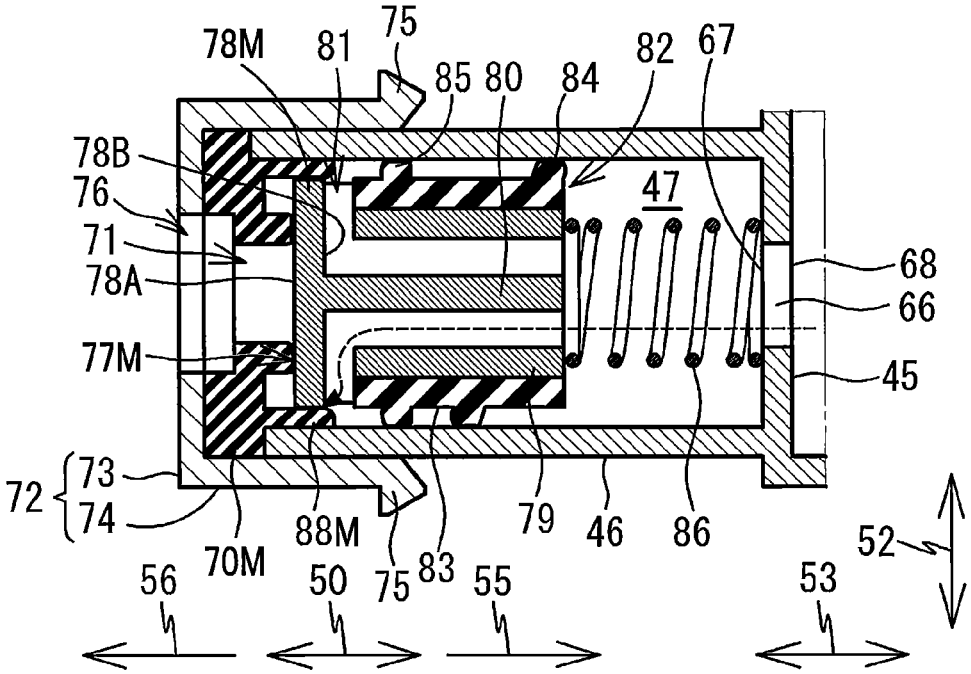
FIG. 11A is an enlarged cross-sectional view of a valve chamber in a vertical cross section of an ink cartridge according to a variation of the second embodiment viewed from its right side when a valve element and a seal member are in a first state.
Figure 11B:
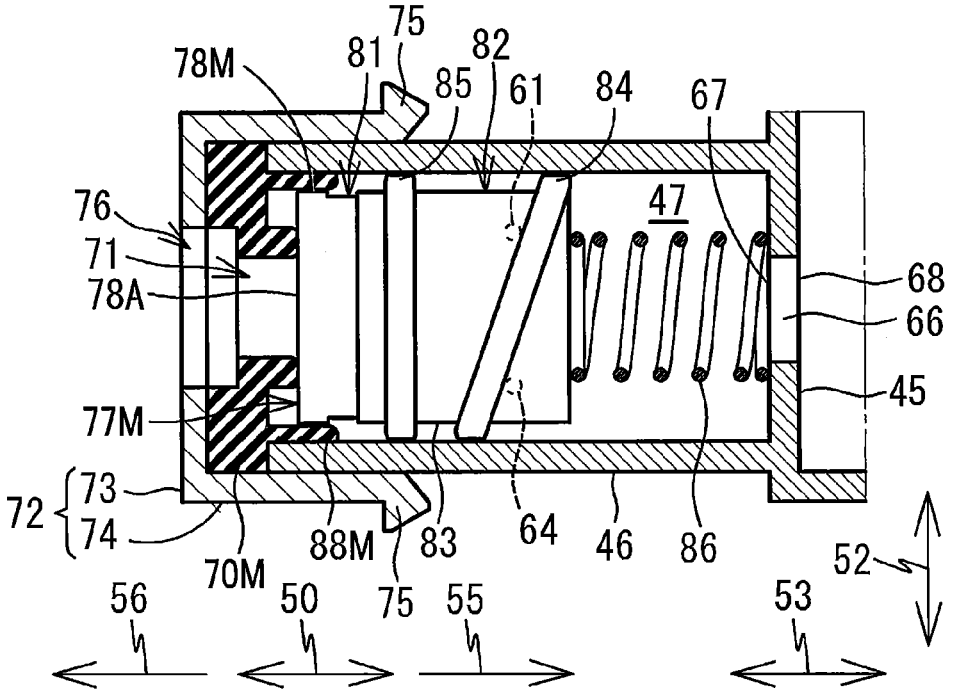
FIG. 11B is an enlarged cross-sectional view of the valve chamber in the vertical cross section of the ink cartridge according to the variation of the second embodiment viewed from its right side when the valve element and seal member are in the first state, wherein the valve element and seal member are shown as a side view and openings formed in the valve chamber are indicated by broken lines.

Specifically, as shown in FIGS. 11A and 11B, the seal part 88M protrudes in the removing direction 55 from the peripheral edge of the seal member 70M at a position for contacting and forming a liquid-tight seal with the outer circumferential surface of the valve 78M. In other words, the outer circumferential surface of the valve 78M serves as the third sealing part. In this variation of the second embodiment, the dimension of the outer circumferential surface of the valve 78M in the mounting and removing directions 50 that contacts the seal part 88M when the valve element 77M and seal member 82 are in the first state is greater than the distance in the mounting and removing directions 50 between the first sealing part 84 and opening 64 when the valve element 77M and seal member 82 are in the first state, and smaller than the distance in the mounting and removing directions 50 between the second sealing part 85 and opening 61 when the valve element 77M and seal member 82 are in the first state.

Still alternatively, while the seal member 70 is provided with the protruding part 71A in the second embodiment described above, the protruding part 71A may be omitted so that the front surface 278A of the valve 278 is separated from the seal member 70 when the valve element 277 and seal member 82 are in the first state. In this case, the third sealing part 287 provided on the valve 278 is inserted into the through-hole 71 of the seal member 70 and closely contacts the same, thereby preventing ink from flowing out of the ink cartridge 30. However, since the seal member 70 in this variation has no contact surface that intersects the mounting direction 56 for receiving the biasing force of the coil spring 86, the coil spring 86 is in a state of near natural length when the valve 278 and seal member 82 are in the first state. Consequently, the valve chamber 47 of this variation will be larger relative to the valve chamber 47 in the first and second embodiments.

4. Variations of the First and Second Embodiments

In the first and second embodiments described above, the third sealing part 287 or 105 is provided on only one of the valve 278 constituting the valve element 277 and ink needle 102, but a third sealing part may be provided on each of the valve 78(278) and ink needle 102(202). In this variation, the total length in the mounting and removing directions 50 of the third sealing parts provided on both the valve 78(278) and ink needle 102(202) is set to be greater than the length in the mounting and removing directions 50 between the first sealing part 84 and opening 64 when the valve element 77(277) and seal member 82 are in the first state and smaller than the distance in the mounting and removing directions 50 between the second sealing part 85 and opening 61 when the valve element 77(277) and seal member 82 are in the first state.

Further, while the first and second sealing parts 84 and 85 viewed in the front-rear direction 53 and a cross section of the inner peripheral surface of the cylindrical wall 46 taken along a plane orthogonal to the mounting direction 56 are elliptical in shape, the cross-sectional shape of these members is not limited to an elliptical shape, but may be another non-circular shape. Further, even if the first and second sealing parts 84 and 85 viewed in the front-rear direction 53 and a cross section of the inner peripheral surface of the cylindrical wall 46 taken along a plane orthogonal to the mounting direction 56 were made circular in shape, other rotation restricting parts may be provided for restricting the seal member 82 from rotating in the valve chamber 47. One example of these rotation restricting parts includes a protruding part that protrudes from the valve element 77(277) toward the inner peripheral surface of the cylindrical wall 46, and a groove part formed in the inner peripheral surface of the cylindrical wall 46 and extending in the front-rear direction 53 for receiving the protruding part therein.

Further, the first sealing part 84 may be any shape, provided that the first sealing part 84 can interrupt communication between the openings 61 and 64 at the valve element 77(277) and seal member 82 in the first state (i.e., an annular shape that circumscribes the entire outer circumferential surface of the cylindrical part 83). For example, the first sealing part 84 may be configured to curve or meander while encircling the outer circumferential surface of the cylindrical part 83 in a direction that intersects the front-rear direction 53. The same structural modifications may be applied to the second sealing part 85.

Further, the position for attaching the semipermeable membrane 44 is not limited to the position of the opening 62 in the embodiments described above, but may be any position along the first air channel 60. Further, it is possible to prevent ink from becoming deposited on the semipermeable membrane 44 and blocking the flow of air therethrough by providing a labyrinthian structure in an arbitrary position along the first air channel 60 between the opening 61 and semipermeable membrane 44.

Further, the first and second sealing parts 84 and 85 may be configured of O-rings or the like that fit into circumferential grooves formed in the retaining part 79, for example.

The position of the valve chamber 47 is also not limited to the example in the embodiments described above. For example, the cylindrical wall 46 may protrude outward from the front surface of the front wall 40, in which case the front wall 40 also serves as the proximal wall 45. Further, the interior of a through-hole penetrating the front wall 40 in its thickness dimension may serve as the valve chamber 47, in which case the cylindrical wall 46 is omitted and the inner circumferential surface (peripheral surface) of the through-hole serves as the side wall surface.

In the first and second embodiments described above, the ink chamber 36 can communication with external air through the first air channel 60, the enclosed space between the first and second sealing parts 84 and 85, and the second air channel 63 when the valve element 77(277) and seal member 82 are in the second state, and the ink chamber 36 can subsequently communicate with the internal space of the ink needle 102 (202) through the first liquid channel 66, the second liquid channel 69, the valve chamber 47, and the communication holes 104 when the valve element 77(277) and seal member 82 are in the third state. However, there is no particular restriction on this order of communication, provided that it is not necessary for the ink chamber 36 to communicate with external air prior to communicating with the internal space of the ink needle 102. For example, if the ink chamber 36 is allowed to communicate with the internal space in the ink needle 102 prior to communicating with the external air, the range in which the valve element 77(277) and seal member 82 move toward the proximal wall 45 may be restricted by a protruding part or stepped surface that protrudes into the internal space of the cylindrical wall 46 to contact the valve element 77(277) and seal member 82 in their second state.

Further, while the through-hole 71 formed in the seal member 70 has a smaller diameter than the outer diameter of the ink needle 102(202) or the third sealing part 287 of the valve 278 in the depicted first and second embodiments, the present invention is not limited to this arrangement. That is, at least part of the through-hole 71 may be closed by the elasticity of the seal member 70 itself when the ink needle 102(202) is not inserted in the through-hole 71. With this configuration, the coil spring 86 need not be provided in the valve chamber 47. If the coil spring 86 is omitted from the valve chamber 47, then once the ink needle 102(202) has moved the valve element 77(277) and seal member 82 into the third state, the valve element 77(277) and seal member 82 will remain in the third state after the ink needle 102(202) is extracted from the valve chamber 47. Therefore, the valve 78(278) will not be in contact with the seal member 70, but the elasticity of the seal member 70 will at least partially close the through-hole 71, suppressing the outflow of ink from the valve chamber 47 through the through-hole 71.

5. Third Embodiment

A configuration according to a third embodiment of the present invention will be described next with reference to FIGS. 12A through 14B.

While the valve element 77 and seal member 82 serve as an example of the movable body in the first embodiment, a retaining part 393 and a seal member 382 serve as the movable body in the third embodiment. Further, while the valve 78 serves to open and close the second liquid channel 69 in the first embodiment, the valve 78 (and the protruding member 80) has been omitted in the third embodiment and a valve element 392 is provided for opening and closing the second liquid channel 69 in the third embodiment. Further, while the ink needle 102 of the first embodiment is provided with the third sealing part 105, an ink needle 302 of the third embodiment is not provided with the third sealing part 105 but instead a contact part 306 is provided on the ink needle 302. The remaining structures in the third embodiment are generally the same as the structures in the first embodiment and, hence, a detailed description therefor has been omitted. Parts and components in FIGS. 12A through 14B having the same reference numerals used in the first embodiment have the same structures as these components in the first embodiment.

Figure 12A:
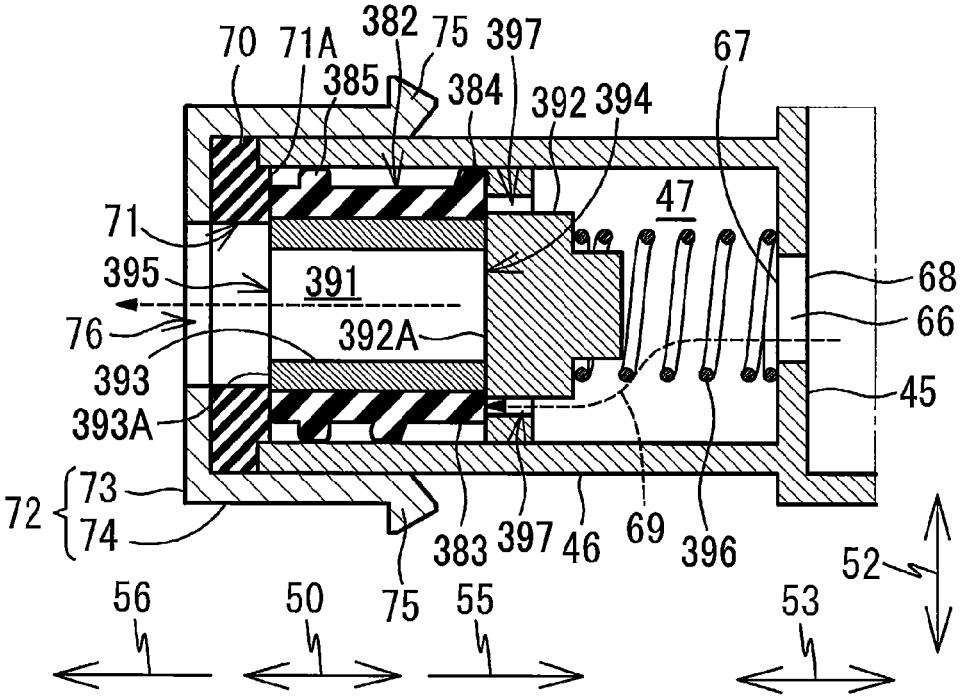
FIG. 12A is an enlarged cross-sectional view of a valve chamber in a vertical cross section of an ink cartridge according to a third embodiment viewed from its right side when a retaining part and a seal member are in a first state and a valve element is in a closed position.
Figure 12B:
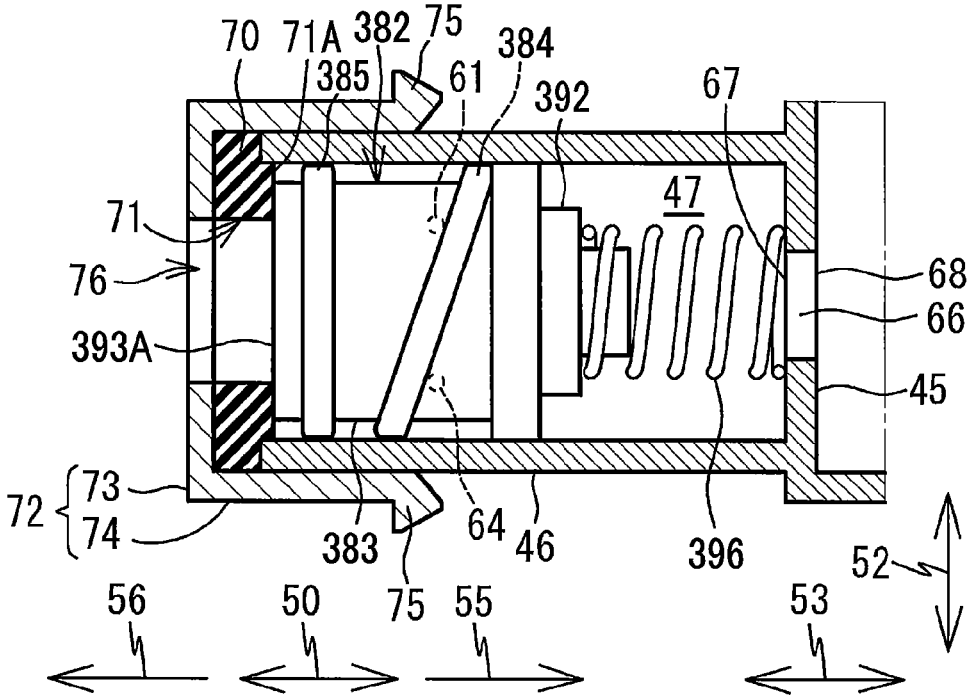
FIG. 12B is an enlarged cross-sectional view of the valve chamber in the vertical cross section of the ink cartridge according to the third embodiment viewed from its right side when the retaining part and the seal member are in the first state and the valve element is in the closed position, wherein the valve element, the seal member and a coil spring are shown as a side view and openings formed in the valve chamber are indicated by broken lines.

As shown in FIGS. 12A and 12B, the valve element 77 and seal member 82 in the first embodiment have been replaced with the retaining part 393, valve element 392, and seal member 382 in the third embodiment. The retaining part 393 has a general cylindrical shape, with a front surface 393A that can contact and form a tight seal with the distal endface of the protruding part 71A protruding from the seal member 70. The retaining part 393 is formed with an opening 394 (an example of a fourth opening of the invention) on the proximal wall 45 side, and an opening 395 (an example of a fifth opening of the invention) on the distal end side of the cylindrical wall 46. A through-hole 391 connecting between the openings 394 and 395 is formed in the retaining part 393 to extend in the front-rear direction 53 and serves as an example of a movable-body through-hole of the invention. The seal member 382 includes a cylindrical part 383 provided around the outer circumferential surface of the retaining part 393. A first sealing part 384 and a second sealing part 385 having the same structure as the first sealing part 84 and the second sealing part 85 respectively are provided on the outer circumferential surface of the cylindrical part 383.

The valve element 392 is disposed on the proximal wall 45 side of the retaining part 393 and serves to open and close the opening 394. The valve element 392 has a general columnar shape with a circular front surface 392A (see FIGS. 13A and 14A). The front surface 392A has an outer diameter larger than the diameter of the opening 394 and substantially equivalent to the inner diameter of the cylindrical wall 46. The front surface 392A of the valve element 392 closes off the opening 394 by contacting a peripheral edge of the retaining part 393 defining the opening 394. At this time, the valve element 392 is in its closed position. Through-holes 397 are formed in the valve element 392 to provide communication between a portion of the valve chamber 47 on the proximal wall 45 side of the valve element 392 and a portion of the valve chamber 47 on the distal end side of the valve element 392. The through-holes 397 form channels that can circulate ink.

A coil spring 396 (an example of a second biasing member of the invention) is disposed between the proximal wall 45 and the valve element 392. More specifically, one end of the coil spring 396 contacts the front surface of the proximal wall 45, and the other end contacts the valve element 392. The coil spring 396 biases the valve element 392 toward the retaining part 393 for maintaining the valve element 392 in the closed position in which the front surface 392A contacts the peripheral edge of the retaining part 393 defining the opening 394.

Note that a plate spring or other biasing member may be used in place of the coil spring 396.

Figure 13A:
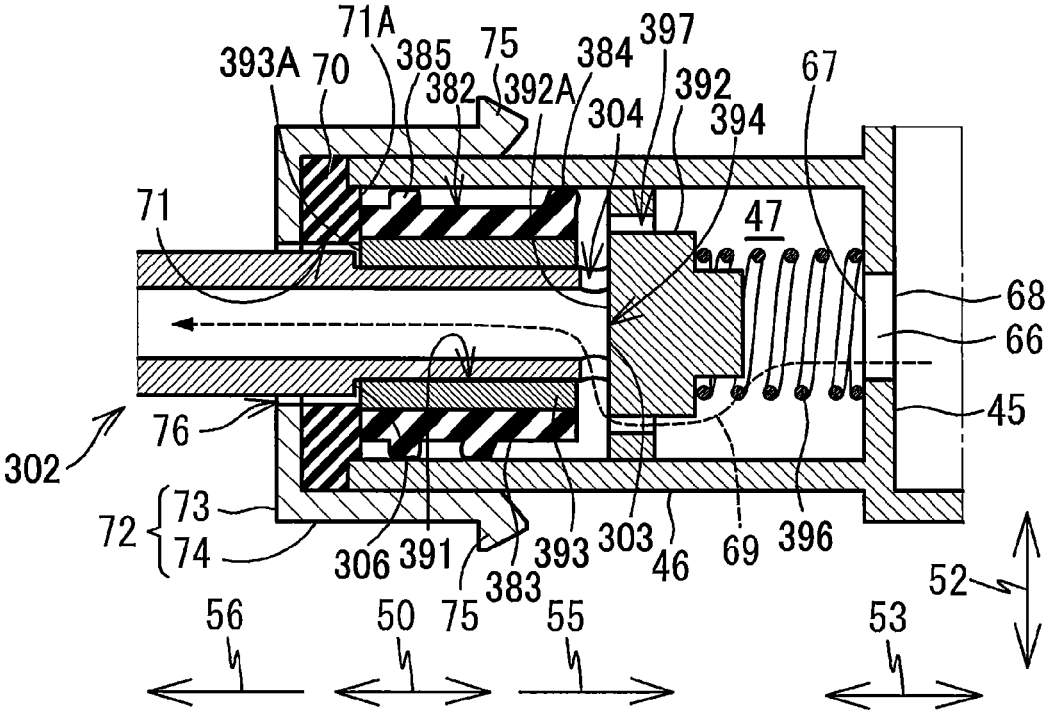
FIG. 13A is an enlarged cross-sectional view of the valve chamber in a vertical cross section of the ink cartridge according to the third embodiment viewed from its right side when the retaining part and the seal member are in the first state and the valve element is in an open position.
Figure 13B:
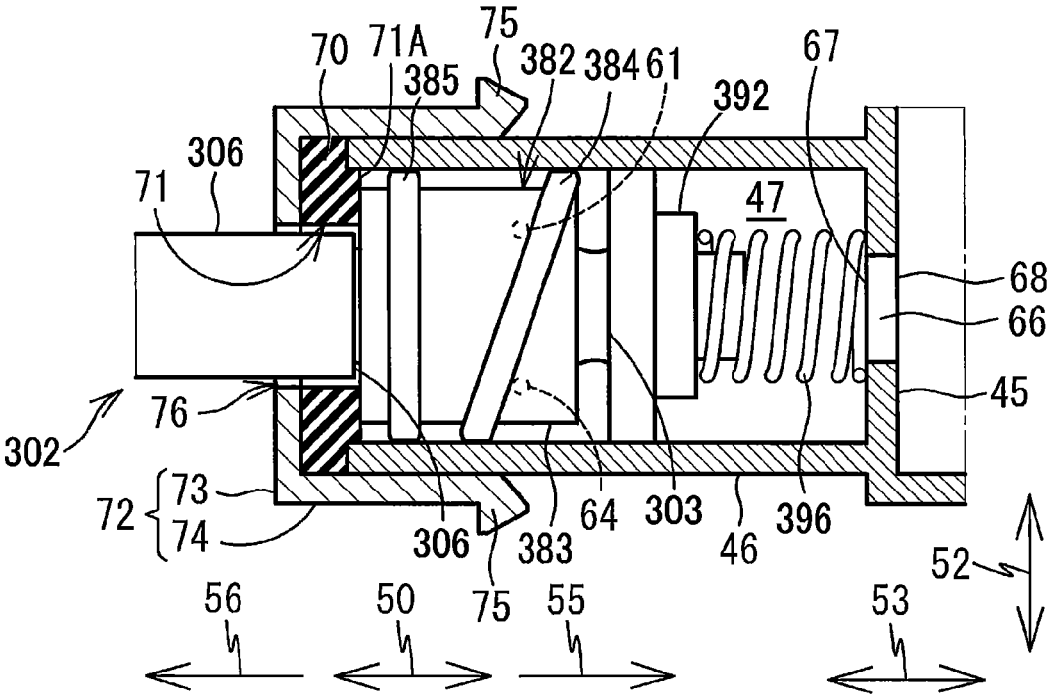
FIG. 13B is an enlarged cross-sectional view of the valve chamber in the vertical cross section of the ink cartridge according to the third embodiment viewed from its right side when the retaining part and the seal member are in the first state and the valve element is in the open position, wherein the valve element, the seal member and the coil spring are shown as a side view and the openings of the valve chamber are indicated by broken lines.

As shown in FIGS. 13A and 13B, the ink needle 302 has the contact part 306 that is separated from a distal end 303 in a direction toward a base end of the ink needle 302 (toward the distal end of the cylindrical wall 46). The contact part 306 is configured as a stepped surface having a larger diameter than the outer diameter of the distal end 303. The outer diameter of the distal end 303 is smaller than the diameter of the through-hole 391 formed in the retaining part 393. Hence, the distal end 303 of the ink needle 302 can be inserted through the through-hole 391. However, the outer diameter of the contact part 306 is sufficiently larger than the diameter of the through-hole 391 so that the contact part 306 cannot be inserted into the through-hole 391. Instead, the contact part 306 contacts the peripheral edge of the retaining part 393 defining the opening 395. A distance in the mounting direction 56 from the distal end 303 to the contact part 306 is greater than a dimension of the through-hole 391 in the mounting direction 56. Therefore, when the contact part 306 is in contact with the peripheral edge of the retaining part 393 defining the opening 395, communication holes 304 of the ink needle 302 protrude out of the through-hole 391 toward the proximal wall 45 side of the opening 394.

Prior to the ink cartridge 30 being mounted in the cartridge-mounting unit 110, the retaining part 393 and seal member 382 are in the first state shown in FIGS. 12A and 12B. In the first state, the retaining part 393 and seal member 382 are made to contact the seal member 70 by the biasing force of the coil spring 396. When the retaining part 393 and seal member 382 are in this first state, the front surface 393A of the retaining part 393 contacts and forms a liquid-tight seal with the peripheral edge of the seal member 70 defining the through-hole 71. Accordingly, the front surface 393A of the retaining part 393 blocks the through-hole 71. Further, by maintaining the valve element 392 in its closed position, the opening 394 of the through-hole 391 is blocked by the valve element 392.

The first sealing part 384 is positioned between the openings 61 and 64, thereby interrupting communication between the first and second air channels 60 and 63. The second sealing part 385 contacts and forms an airtight seal with the inner peripheral surface of the cylindrical wall 46 at a position toward the distal end of the cylindrical wall 46 from the opening 61. Accordingly, the second sealing part 385 interrupts communication between the first air channel 60 and through-hole 71.

FIGS. 13A and 13B show a state of components in the valve chamber 47 as the ink cartridge 30 is being mounted in the cartridge-mounting unit 110 (in a state where the contact part 306 of the ink needle 302 has contacted the retaining part 393). When the ink cartridge 30 is in the process of being mounted into the cartridge-mounting unit 110, the distal end 303 of the ink needle 302 passes through the through-hole 371 in the seal member 70 and enters into the through-hole 391 formed in the retaining part 393 through the opening 395. Since a gap exists between the circumferential surface of the ink needle 302 on the distal end 303 side of the contact part 306 and the inner surface of the retaining part 393 defining the through-hole 391, the distal end 303 of the ink needle 302 can advance through the through-hole 391 without moving the retaining part 393 and seal member 382 from their first state. Therefore, communication remains interrupted between the first and second air channels 60 and 63.

When the distal end 303 of the ink needle 302 contacts the valve element 392, pressure from the ink needle 302 moves the valve element 392 against the biasing force of the coil spring 396 from its closed position to an open position, i.e., a position separated from the opening 394 of the retaining part 393. Once the communication holes 304 formed in the ink needle 302 have advanced through the opening 394 into the proximal wall 45 side of the valve chamber 47, the ink chamber 36 is in communication with the interior of the ink needle 302 through the first liquid channel 66, the through-holes 397, and the communication holes 304, enabling ink to circulate therethrough.

Figure 14A:
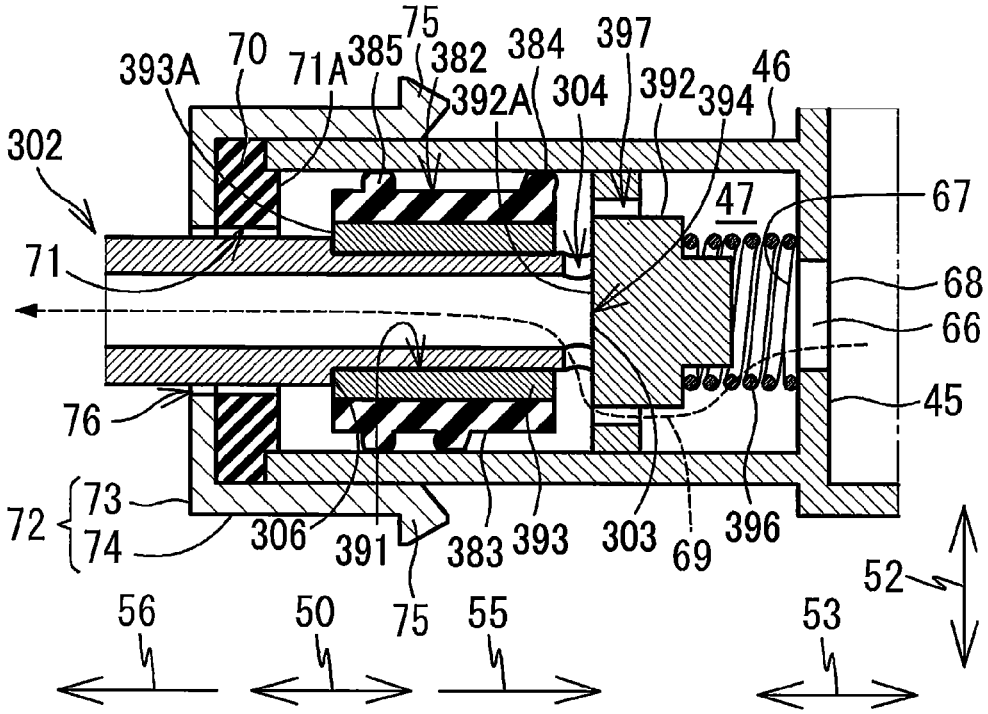
FIG. 14A is an enlarged cross-sectional view of the valve chamber in a vertical cross section of the ink cartridge according to the third embodiment viewed from its right side when the retaining part and the seal member are in a second state and the valve element is in the open position.
Figure 14B:
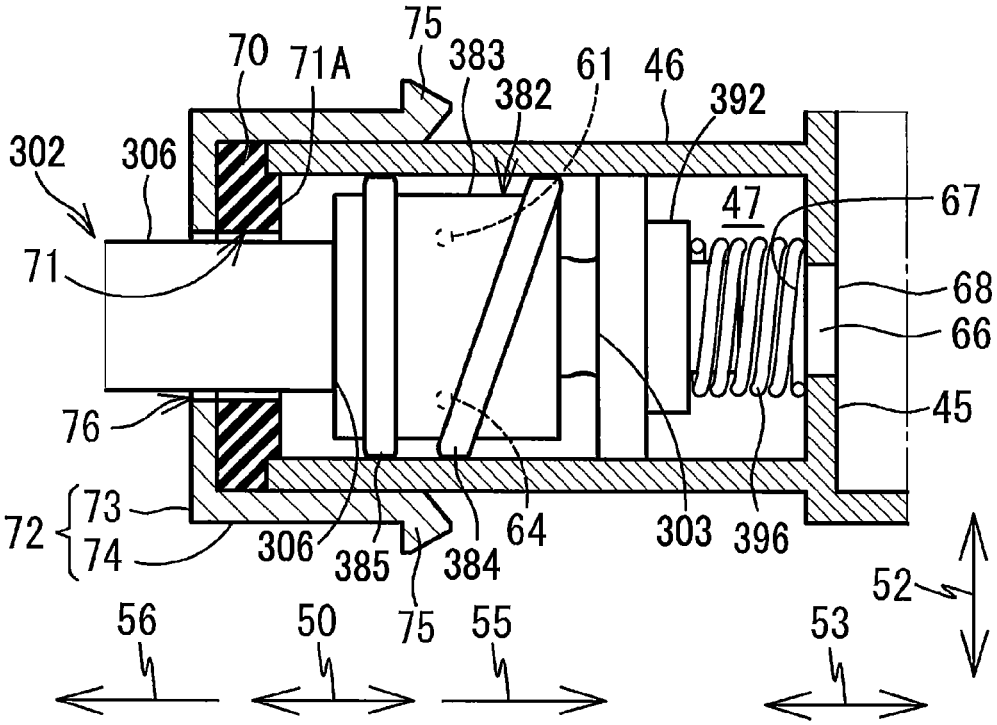
FIG. 14B is an enlarged cross-sectional view of the valve chamber in the vertical cross section of the ink cartridge according to the third embodiment viewed from its right side when the retaining part and the seal member are in the second state and the valve element is in the open position, wherein the valve element, the seal member and the coil spring are shown as a side view and the openings of the valve chamber are indicated by broken lines.

FIGS. 14A and 14B show a state of components in the valve chamber 47 once the ink cartridge 30 has been completely mounted in the cartridge-mounting unit 110. When the ink cartridge 30 is completely mounted in the cartridge-mounting unit 110, the retaining part 393 and seal member 382 have moved from the first state into a second state closer to the proximal wall 45 side of the cylindrical wall 46 because the contact part 306 of the ink needle 302 inserted further into the valve chamber 47 has contacted and pressed against the peripheral edge of the retaining part 393 defining the opening 395. The valve element 392 has also moved further toward the proximal wall 45 against the biasing force of the coil spring 396 due to pressure from the distal end 303 of the ink needle 302.

When the retaining part 393 and seal member 382 are in this second state, the first sealing part 384 is positioned between the openings 61, 64 and the opening 67. Specifically, the first sealing part 384 contacts and forms an airtight seal with the inner peripheral surface of the cylindrical wall 46 on the proximal wall 45 side of the cylindrical wall 46 from the openings 61, 64 and on the distal end side of the cylindrical wall 46 from the opening 67, thereby allowing communication between the first and second air channels 60 and 63, while interrupting communication between the second air channel 63 and first liquid channel 66. Consequently, the ink chamber 36 is in communication with external air through the first air channel 60, the enclosed space between the first and second sealing parts 384 and 385 (the valve chamber 47), and the second air channel 63. The second sealing part 385 contacts and forms an airtight seal with the inner peripheral surface of the cylindrical wall 46 at a position toward the distal end of the cylindrical wall 46 from the openings 61, 64. Accordingly, the second sealing part 385 interrupts communication between the first and second air channels 60 and 63 and the through-hole 71.

The third embodiment described above can obtain the same operational advantages described in the first embodiment.

While the invention has been described in detail with reference to the specific embodiment thereof, it would be apparent to those skilled in the art that various changes and modifications may be made therein without departing from the scope of the invention.

What is claimed is:

1. A liquid cartridge comprising:

a liquid chamber configured to store liquid therein;

a valve chamber extending in a first direction away from the liquid chamber, the valve chamber being defined by a side wall surface and a proximal wall surface, the side wall surface extending in the first direction and having an annular-shaped cross-section taken along a plane orthogonal to the first direction, the side wall surface having a first end and a second end positioned downstream of the first end in the first direction, the proximal wall surface provided on the first end of the side wall surface, the side wall surface defining a circumferential direction and being formed with a first opening and a second opening, the first opening and the second opening being separated from each other in the circumferential direction and at least partially overlapping the plane;

a first air channel configured to allow air to flow between the valve chamber and ambient air through the first opening;

a second air channel configured to allow air to flow between the liquid chamber and the valve chamber through the second opening;

a movable body disposed within the valve chamber and configured to move in a in a second direction opposite to the first direction from a first state to a second state, the movable body having an outer surface;

a first sealing part having an annular shape and provided on the outer surface of the movable body, the first sealing part being in close contact with the side wall surface and configured to move in the second direction; and a second sealing part having an annular shape and provided on the outer surface of the movable body at a position toward the second end of the side wall surface from the first sealing part, the second sealing part being in close contact with the side wall surface and configured to move in the second direction, the first sealing part and the second sealing part defining an enclosed space therebetween in the valve chamber, wherein;

when the movable body is in the first state, the first sealing part is positioned between the first opening and the second opening and interrupts communication therebetween, the second sealing part being positioned toward the second end of the side wall surface from the first opening and the second opening; and when the movable body is in the second state, the first opening and the second opening are in communication with each other for allowing air to flow therebetween through the enclosed space.

2. The liquid cartridge as claimed in claim 1, wherein the movable body further comprises a rotation restricting part configured to restrict the movable body from rotating in the circumferential direction within the valve chamber.

3. The liquid cartridge as claimed in claim 2, wherein the rotation restricting part has a non-circular shaped cross-section taken along the plane.

4. The liquid cartridge as claimed in claim 2, wherein the rotation restricting part comprises:

a protruding part protruding from the movable body toward the side wall surface; and a groove part formed in the side wall surface and extending in the second direction for receiving the protruding part.

5. The liquid cartridge as claimed in claim 1, further comprising:

a liquid channel configured to allow liquid to flow between the liquid chamber and a portion of the valve chamber toward the second end of the side wall surface from the second sealing part; and a seal member provided on the second end of the side wall surface, the seal member being formed with a through-hole through which an interior and an exterior of the valve chamber are in communication with each other, the through-hole being defined by a peripheral surface, wherein the movable body includes a closing part configured to contact the seal member to close the through-hole, the closing part of the movable body in the first state closing the through-hole.

6. The liquid cartridge as claimed in claim 5, wherein the closing part is provided with a third sealing part configured to make close contact with the peripheral surface defining the through-hole and slide relative to the peripheral surface, the third sealing part being separated from the peripheral surface when the movable body moves further downstream in the second direction from the second state.

7. The liquid cartridge as claimed in claim 6, further comprising a first biasing member disposed within the valve chamber between the movable body and the proximal wall surface, the first biasing member being configured to bias the movable body in the first direction, wherein the movable body is configured to move in the first direction and in the second direction within the valve chamber.

8. The liquid cartridge as claimed in claim 7, wherein the seal member includes a contact surface intersecting the first direction, and wherein the closing part is in contact with the contact surface of the seal member biased in the first direction to maintain the movable body in the first state.

9. The liquid cartridge as claimed in claim 5, wherein the liquid channel comprises:

a first liquid channel configured to allow liquid to flow between the valve chamber and the liquid chamber through a third opening formed in the valve chamber near the first end of the side wall surface; and a second liquid channel including a movable-body through-hole penetrating through the movable body, the movable-body through-hole connecting between a fourth opening and a fifth opening, the fourth opening being open on the movable body toward the first end of the side wall surface and the fifth opening being open on the movable body toward the second end of the side wall surface.

10. The liquid cartridge as claimed in claim 9, wherein the third opening is formed in the proximal wall surface.

11. The liquid cartridge as claimed in claim 1, further comprising:

a liquid channel configured to allow liquid to flow between the liquid chamber and a portion of the valve chamber toward the second end of the side wall surface from the second sealing part; and a valve element movably disposed within the valve chamber, wherein the liquid channel includes:

a first liquid channel configured to allow liquid to flow between the valve chamber and the liquid chamber through a third opening formed in the valve chamber near the first end of the side wall surface; and a second liquid channel including a movable-body through-hole formed in the movable body to penetrate therethrough in the second direction, the movable-body through-hole connecting between a fourth opening and a fifth opening, the fourth opening being open on the movable body toward the first end of the side wall surface and the fifth opening being open on the movable body toward the second end of the side wall surface, the fourth opening being configured to be closed by the valve element, and wherein the valve element is configured to move from a closed position to close the fourth opening to an open position to open the fourth opening in response to insertion of a liquid extraction tube into the movable-body through-hole in the second direction.

12. The liquid cartridge as claimed in claim 11, wherein the liquid extraction tube moves in the second direction relative to the movable body in the first state and contacts the valve element to move the valve element from the closed position to the open position.

13. The liquid cartridge as claimed in claim 12, wherein the movable body moves from the first state to the second state upon contact of the movable body against the liquid extraction tube moving in the second direction.

14. The liquid cartridge as claimed in claim 11, further comprising a second biasing member disposed within the valve chamber between the valve element and the proximal wall surface, the second biasing member being configured to bias the valve element toward the closed position.

* * * * *